US006902467B2

(12) United States Patent
Jinbo

(10) Patent No.: US 6,902,467 B2
(45) Date of Patent: Jun. 7, 2005

(54) APPARATUS FOR PROCESSING A LENS AND PROCESS FOR PROCESSING A LENS

(75) Inventor: Masahiro Jinbo, Shinjyukuku-ku (JP)

(73) Assignee: Hoya Corporation, Tokyo (JP)

( * ) Notice: Subject to any disclaimer, the term of this patent is extended or adjusted under 35 U.S.C. 154(b) by 10 days.

(21) Appl. No.: 10/448,355

(22) Filed: May 30, 2003

(65) Prior Publication Data

US 2004/0048555 A1 Mar. 11, 2004

(30) Foreign Application Priority Data

May 30, 2002 (JP) ..... 2002-157047

(51) Int. Cl.[7] ..... B24B 1/00

(52) U.S. Cl. ..... 451/5; 451/42; 451/43; 451/255; 451/256; 451/449

(58) Field of Search ..... 451/5, 488, 449, 451/42, 240, 255, 256, 277, 178, 257, 323, 43; 15/214; 351/177, 168; 528/65

(56) References Cited

U.S. PATENT DOCUMENTS

| | | | | | |
|---|---|---|---|---|---|
| 3,978,620 | A | * | 9/1976 | Feneberg et al. | 451/256 |
| 5,128,434 | A | * | 7/1992 | Lai | 528/65 |
| 5,811,506 | A | | 9/1998 | Slagel | |
| 5,962,617 | A | | 10/1999 | Slagel | |
| 5,993,294 | A | * | 11/1999 | Gottschald | 451/43 |
| 5,993,295 | A | | 11/1999 | Raffaelli | |
| 6,062,947 | A | * | 5/2000 | Obayashi et al. | 451/5 |
| 6,127,505 | A | | 10/2000 | Slagel | |
| 6,170,952 | B1 | * | 1/2001 | La Haye et al. | 351/168 |
| 6,250,989 | B1 | * | 6/2001 | Mizuno | 451/5 |
| 6,261,150 | B1 | * | 7/2001 | Mizuno et al. | 451/5 |
| 6,497,614 | B2 | * | 12/2002 | Kobayashi et al. | 451/43 |
| 6,572,460 | B2 | * | 6/2003 | Mizuno | 451/178 |
| 6,648,738 | B2 | * | 11/2003 | Eto et al. | 451/254 |
| 6,672,944 | B2 | * | 1/2004 | Eto et al. | 451/43 |
| 6,702,653 | B2 | * | 3/2004 | Shibata | 451/42 |

FOREIGN PATENT DOCUMENTS

| | | | |
|---|---|---|---|
| DE | 4009942 | A1 | 10/1991 |
| DE | 4334887 | A1 | 8/1994 |
| EP | 0688125 | A2 | 8/1995 |
| EP | 0 839 604 | A | 5/1998 |
| EP | 1 155 755 | A | 11/2001 |
| EP | 1197505 | A1 | 4/2002 |
| JP | 647656 | | 2/1994 |
| JP | 60-47656 | | 2/1994 |
| JP | 2002-504935 | | 7/1997 |
| JP | 0511231 | T2 | 8/2000 |
| JP | 2002-018686 | | 1/2002 |
| JP | 2002018686 | A2 | 1/2002 |
| JP | 2002504935 | T2 | 2/2002 |
| WO | WO 96/23827 | | 8/1996 |
| WO | WO 97/44373 | | 11/1997 |

OTHER PUBLICATIONS

European Search Report dated Dec. 8, 2003.

European Search Report for EP 03011751, completed Feb. 4, 2004, by M. Garella, at the Hague, and mailed Feb. 13, 2004.

* cited by examiner

*Primary Examiner*—George Nguyen
(74) *Attorney, Agent, or Firm*—Griffin & Szipl, P.C.

(57) ABSTRACT

A apparatus comprises a portion for setting a load 133 which sets the load of pressing a lens to a rotating tool, a portion for setting the rotation speed of a lens shaft 132 which sets the rotation speed and the direction of rotation of a lens-holding shaft and a portion for setting the condition of water supply 134 which sets the condition for injecting a cooling liquid to the lens. These conditions are set in each step of the processing of the lens. The load, the relative directions of rotation of the lens and the rotating tool (the up cut or the down cut) and the condition for injecting the cooling liquid are controlled based on the conditions of the processing set by the above portions.

11 Claims, 16 Drawing Sheets

FIG. 15

(a)

PROCESSING FOR THE ROUGH GRINDING

| | GRINDING SPEED (m/min) | ROTATION SPEED OF THE LENS SHAFT (rpm) | DIRECTION FOR THE GRINDING | LOAD (kgf) | WATER SUPPLY |
|---|---|---|---|---|---|
| GLASS | 1000 | 5～6 | DOWN | 4 | DRY |
| PLASTIC 1 | 1000 | 5～6 | DOWN | 3.5 | DRY |
| PLASTIC 2 | 1000 | 5～6 | DOWN | 3.5 | DRY |
| PLASTIC 3 | 1100 ～ 1256 | 7.5～10 | UP | 2(3<) | DRY |

(b)

PROCESSING FOR THE FINISHING

| | GRINDING SPEED (m/min) | ROTATION SPEED OF THE LENS SHAFT (rpm) | DIRECTION FOR THE GRINDING | LOAD (kgf) | WATER SUPPLY |
|---|---|---|---|---|---|
| GLASS | 1000 | 5～6 | DOWN | 4 | Wet |
| PLASTIC 1 | 1000 | 5～6 | DOWN | 3.5 | Wet |
| PLASTIC 2 | 1000 | 5～6 | DOWN | 3.5 | Wet |
| PLASTIC 3 | 1000 | 5～6 | UP | 2 | dry→Wet |

APPARATUS FOR PROCESSING A LENS AND PROCESS FOR PROCESSING A LENS

This application claims priority from Japanese Patent Application No. 2002-157047, filed May 30, 2002, the entire disclosure of which is incorporated herein by reference.

FIELD OF THE INVENTION

The present invention relates to an apparatus for processing a lens, which is used for processing the peripheral portion of a lens such as a spectacle lens to provide a prescribed shape so that the lens can be fitted into a the lens portion of a spectacle frame.

BACKGROUND OF THE INVENTION

Heretofore, when a lens such as a spectacle lens is processed so that the lens is fitted into the lens portion of a spectacle frame, the peripheral face of an uncut lens is ground by a grinder or cut by a cutter, and the uncut lens is formed into a prescribed shape of the peripheral portion in accordance with data of the shape of the lens portion of the spectacle frame.

Examples of a known processing apparatus for this purpose include, as disclosed in Japanese Patent Application Laid-Open No. 2002-18686, apparatuses in which a rotating tool (a grinder), which can be freely rotated and grinds the peripheral face of the lens, is disposed around a first shaft on a base. The position of grinding or cutting is set by driving a second shaft supporting the lens, which can be freely swung relative to the first shaft of the rotating tool, towards the first shaft of the rotating tool by an arm, and rotating the lens around the axis of the second shaft.

These apparatuses are equipped with a control portion in which selections are made among the types of processing such as the flat processing and the beveled processing and selection among the modes of processing are made such as the crude processing, finishing, mirror finishing, grooving and chamfering. The pressure of chucks and the tools used for the processing are set in accordance with the material of the lens (glasses, plastics, polycarbonates and acrylic resins). The peripheral portion of the lens is processed based on shape data of the lens frame.

In recent years, various types of resins are used for the lens so that the refractive index is increased and the impact resistance is improved. Processability is different depending on the material.

In the conventional apparatuses described above, processing is conducted by setting the processing condition such as the direction of rotation of the lens axis (the up cut and the down cut) and the presence or the absence of water supply in accordance with the material of the lens. When a lens made of a new material is processed, occasionally, the conditions which can be set are insufficient, and processing cannot be conducted smoothly.

For example, as disclosed in Japanese Patent Application Laid-Open Nos. 2000-511231 and 2002-504935 (PCT National Phase Applications), the processing of a lens exhibiting excellent impact resistance such a lens made of a polyurethane-based resin, which is formed with a polyurethane material prepared from an aliphatic diisocyanate compound, an intermediate compound having hydroxyl group selected from polyester glycols, polyether glycols and mixtures of these glycols and a curing agent of an aromatic primary diamine, has certain problems. For example, melted dust and debris of grinding having the shape of ribbons and strings is occasionally attached at the peripheral portion of the processed lens in both of wet processing using cooling water and dry processing without using cooling water, and the dust and debris at the peripheral portion of the lens must be manually removed after the processing has been conducted. This procedure increases the time and the labor required for the processing of the lens.

SUMMARY OF THE INVENTION

It is an object of the present invention to overcome the above problem and it is another object to achieve sure based on shape data of lens portion of a spectacle frame independently of the material of the lens.

In accordance with the above objects, there is provided an apparatus for processing a lens displaces a lens supported by a holding shaft relatively to a main shaft equipped with a rotating tool and processes a peripheral portion of a spectacle lens in accordance with shape data of a lens frame. The apparatus comprises: a means for adjusting a load that changes a load of pressing the lens to the rotating tool; a means for driving a lens shaft that changes a rotational speed and a direction of rotation of the holding shaft; a means for cooling that injects a cooling liquid to the lens; a means for setting processing conditions that sets controlling conditions of the means for adjusting a load, the means for driving a lens shaft and the means for cooling, in every step of processing the lens; and a means for control that controls the means for adjusting a load, the means for driving a lens shaft and the means for cooling based on the controlling conditions set by the means for setting processing conditions. The processing can be conducted under the load, the relative directions of rotation of the lens and the rotating tool (the up cut or the down cut) and the condition of injection of cooling water in accordance with the material of the lens, which may be different in each case.

Also in accordance with the above objects, there is provided a process for processing a lens, comprising: displacing a lens for spectacles made of a resin and supported by a holding shaft relatively to a main shaft having a rotating tool and processing a peripheral portion of the lens in accordance with shape data of a lens frame. The lens made of a resin is formed with a polyurethane material which is prepared from an aliphatic diisocyanate compound, an intermediate compound having hydroxyl group which is selected from polyester glycols, polyether glycols and mixtures of the glycols and a curing agent of an aromatic primary diamine. In the processing, the lens is pressed to the rotating tool under a load set at a value of 2 kgf or greater and smaller than 3 kgf, the injection of the cooling liquid is stopped, and rotation of the holding shaft and rotation of the main shaft are set to be in the same direction.

In accordance with the present invention, since the load can be set as desired, not only conventional materials such as glasses, CR-39 and polycarbonates but also new materials can be processed. Since the direction of the processing (the up cut or the down cut) and the condition of water supply can be changed in every step of the processing such as the rough grinding and the finishing, materials requiring different conditions in every step can be surely processed.

In one embodiment, the material of the lens is a polyurethane material which is prepared from an aliphatic diisocyanate compound, an intermediate compound having hydroxyl group which is selected from polyester glycols, polyether glycols and mixtures of the glycols and a curing agent of an aromatic primary diamine. In this embodiment, melting (attachment) of dust and debris of grinding is prevented and the processing can be conducted smoothly by pressing the lens to the rotating tool under a load of 2 kgf or greater and smaller than 3 kgf and processing in the up cut condition in which the rotation of the holding shaft and the rotation of the main shaft are set in the same direction.

In accordance with a further embodiment there is provided an apparatus for processing a lens. The apparatus comprises a lens holding unit displaceable in a vertical direction and having a lens shaft arranged to hold a lens to be processed. Also provided is a main shaft unit equipped with a rotating tool and disposed to processes a peripheral portion of a spectacle lens held in the lens holding unit in accordance with shape data of a lens portion of a spectacle frame, when the lens holding unit is displaced to contact a lens held in the lens holding unit with the rotating tool. A load adjusting device is provided equipped to adjust a load pressing the lens to the rotating tool. A lens shaft drive is connected to drive the lens shaft with a changeable rotational speed and direction of rotation. A cooling device is arranged to inject a cooling liquid toward a lens held in the lens shaft. A means is provided for setting processing conditions for the load adjusting device, the drive and the cooling device, having an output. A control means is provided for controlling the load adjusting device, the drive and the cooling device based on output from the means for setting processing conditions.

In accordance with yet another embodiment, the means for setting processing conditions sets in advance controlling conditions in a plurality of processing steps for a plurality of lens materials.

In accordance with a still further embodiment, the means for control comprises a means for switching a cooling condition which switches between running and stopping of injection of the cooling liquid by the cooling device during the processing and the means for setting processing conditions sets running or stopping of injection in a plurality of processing steps.

In accordance with yet another embodiment, the apparatus further comprises a main shaft drive connected to drive the main shaft unit with a changeable rotational speed; and the means for setting processing conditions sets a rotation speed of the main shaft in a plurality of processing steps and the means for control controls the main shaft drive based on the output of the means for setting processing conditions.

In accordance with a still further embodiment of the invention, there is provided a process for processing a lens, comprising the steps of: (a) supporting a lens on a shaft of a lens support unit; (b) displacing the lens relatively to a main shaft having a rotating tool and processing a peripheral portion of the lens in accordance with shape data a lens portion of a spectacle frame; wherein the processing further comprises the steps of: (c) rough grinding by pressing the lens to the rotating tool under a load set in advance and grinding the lens roughly; and (d) finishing by pressing the lens to the rotating tool under a load set in advance, wherein the finishing is started without injection of a cooling liquid, and completed with injection of the cooling liquid.

In another embodiment, the process further comprises changing the load accordance with a material of the lens.

In yet another embodiment, the lens is formed with a polyurethane-based resin, the loads are set at a value of 2 kgf or greater and smaller than 3 kgf, and rotation of the holding shaft and rotation of the main shaft are set in same direction.

In a still further embodiment, there is provided a process for processing a lens comprising the steps of: supporting a resin lens with the lens holding shaft of a lens holding unit; displacing the lens relatively to a main shaft having a rotating tool and processing a peripheral portion of the lens in accordance with shape data of lens portion of a spectacle frame; wherein the processing further comprises the steps of pressing the lens to the rotating tool under a load set in advance, stopping injection of a cooling liquid and setting rotation of the lens holding shaft and rotation of the main shaft in the same direction; and wherein the lens comprises a polyurethane material prepared from an aliphatic diisocyanate compound, an intermediate compound having hydroxyl group which is selected from polyester glycols, polyether glycols and mixtures of the glycols and a curing agent of an aromatic primary diamine.

In yet another embodiment, the load is set at a value of 2 kgf or greater and smaller than 3 kgf.

Further objects, features and advantages of the present invention will become apparent from the Detailed Description of Illustrative Embodiments, which follows, when considered together with the attached figures.

BRIEF DESCRIPTION OF THE DRAWINGS

An illustrative embodiment of the present invention will be described as follows with reference to Figures.

FIG. 15 shows an example of the table of the conditions of the processing in accordance with the material of the lens, wherein (A) shows the table for the rough grinding and (B) shows the table for the finishing.

DESCRIPTION OF THE ILLUSTRATIVE EMBODIMENTS

Figure 1:
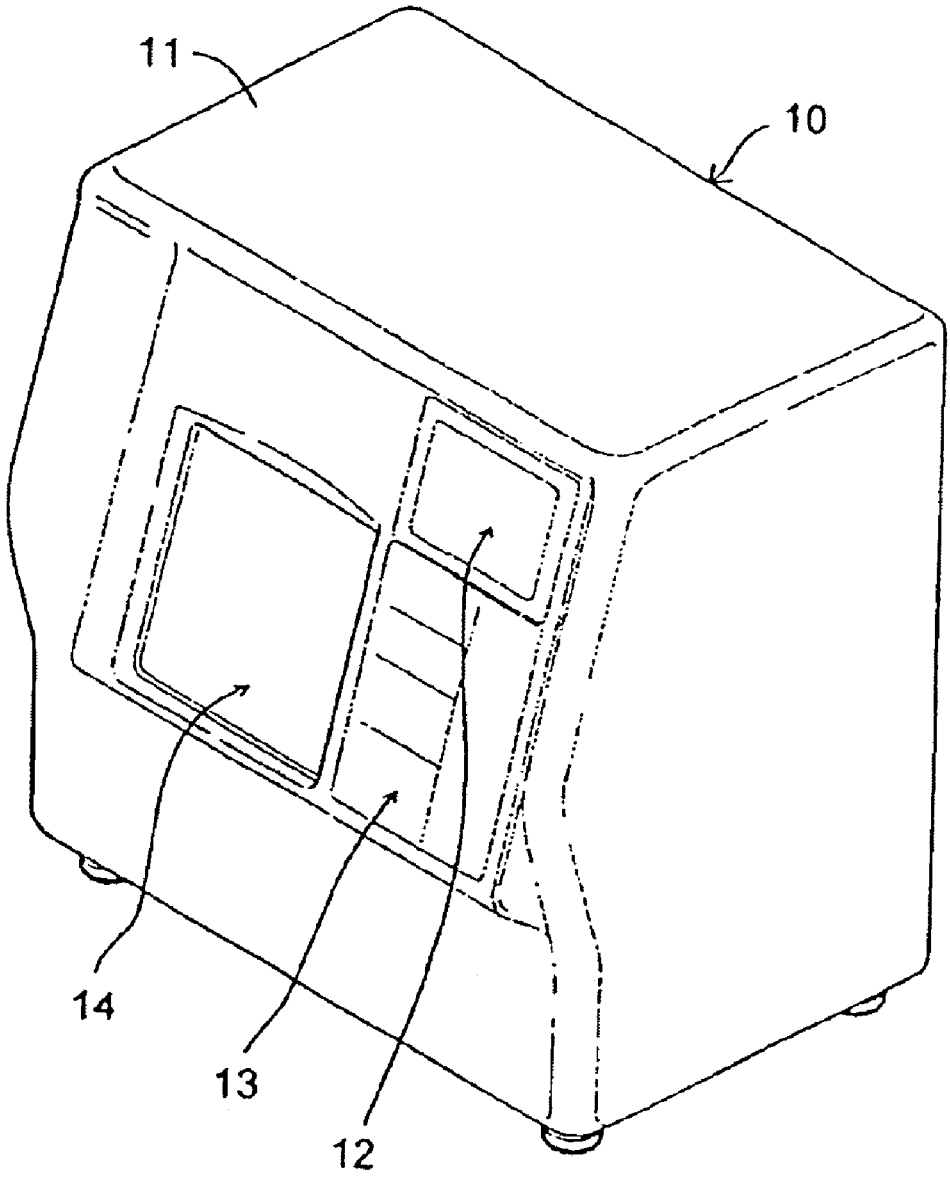
FIG. 1 shows a perspective view of the appearance of the apparatus for processing a lens according to one embodiment of the present invention.

The invention will now be described in terms of certain illustrative embodiments and with reference to the figures in which like reference numerals are given like meanings.

In FIG. 1, at the right side of the front of the apparatus for processing a lens 10 contained in a case having the shape of a rectangular parallelpiped 11, an operation portion 13 for selecting or inputting the conditions for processing the lens and a display portion 12 for displaying information on the processing such as the data of the shape of the lens frame and the data for the processing are disposed. The operation portion 13 comprises touch panels, touch switches, keys or the like. The display portion 12 comprises an LCD, CRT, or the like.

At the front center of the apparatus for processing a lens 10, a door 14 is disposed that can be opened or closed as desired and used for inserting or taking out a lens.

After the entire apparatus is described, the constituent portions will be described in detail.

Outline of the Apparatus

Figure 2:
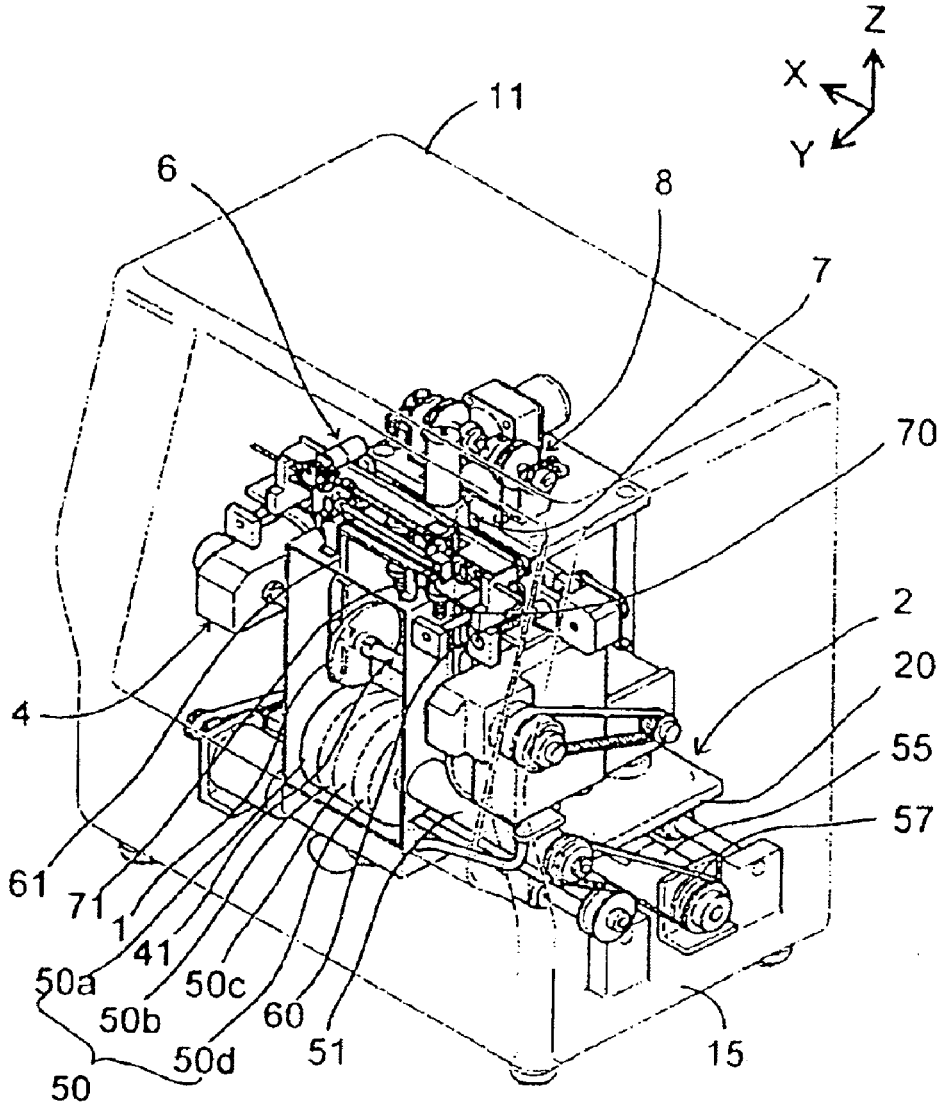
FIG. 2 shows a perspective view exhibiting the main portions of the inner construction of the apparatus according to an embodiment of the present invention.

In FIG. 2, a base unit 2 that can be displaced in a direction parallel to a main shaft 51 having a main rotating tool 50 (a main means for processing) (the direction of the X-axis in the Figure) is disposed inside of the case 11. The base unit 2 supports a lens unit (a lens-holding unit) 4 that can be displaced in the vertical direction (in the direction of the Z-axis in the Figures).

Figure 4:
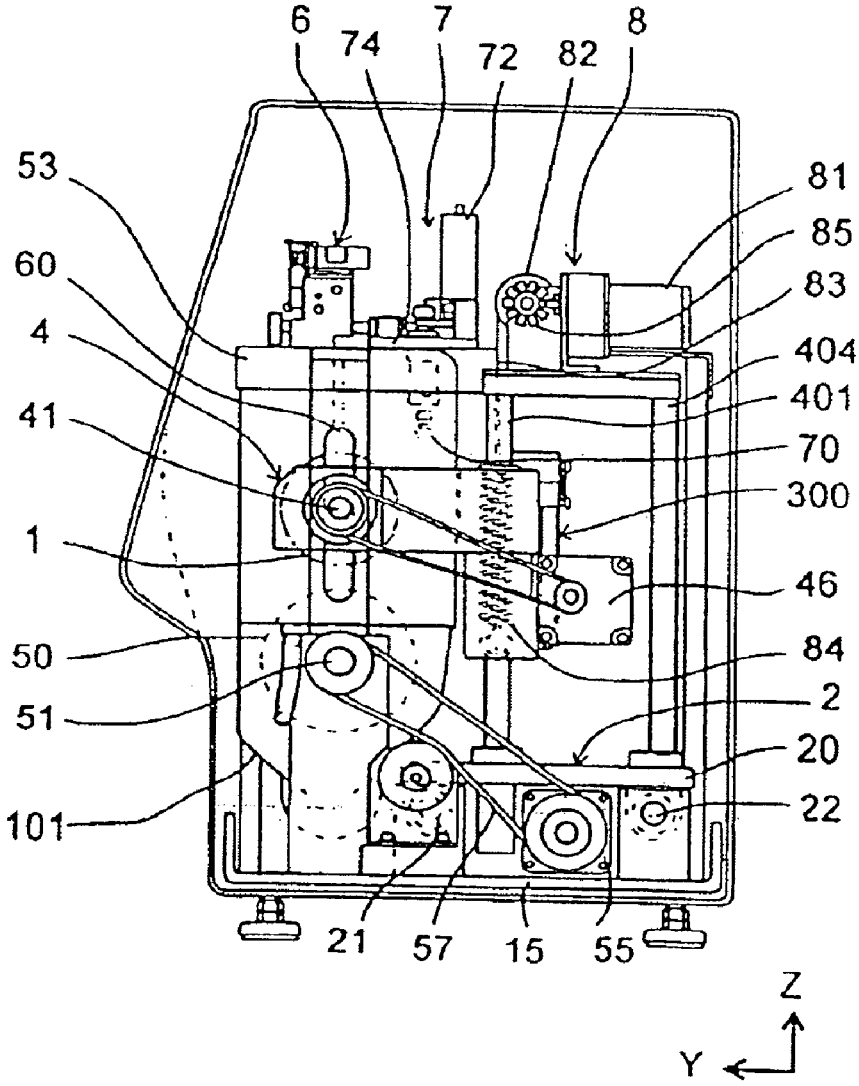
FIG. 4 shows a right side view exhibiting the inner construction of an embodiment of present invention.

In FIG. 2, the transverse direction of the apparatus for processing a lens 10 is assigned to the X-axis, the vertical direction (the direction of the height of the apparatus) is assigned to the Z-axis, and the direction from the left to the right in FIG. 4 (the direction towards the inside of the apparatus) is assigned to the Y-axis. It is assumed that these axes orthogonally intersect each other.

In the lens unit 4, a lens-holding shaft 41, that is divided into two portions and selectively holds the center of the lens 1 between the two portions, is disposed in a manner such that the lens-holding shaft can be freely rotated. The lens-holding shaft 41 is placed on the vertical line of the main rotating tool (a grinder or a cutter) 50 that is supported by a shaft on a base plate 15. The lens-holding shaft 41 and the main shaft 51 of the main rotating tool 50 are arranged parallel to each other along the X-axis. The lens 1 is held by the lens-holding shaft 41 so that the face of the lens 1 is placed along a plane perpendicular to the axial line of the lens holding shaft.

A measuring unit 6 comprising styluses 60 and 61 for measuring positions on the concave face and the convex face, respectively, of the lens 1 is fixed on the vertical line of the lens-holding shaft 41.

The styluses 60 and 61 are displaceable in a direction parallel to the lens-holding shaft 41. For the measurement of the position of the lens 1 after being completely processed and the thickness of the peripheral edge, the styluses 60 and 61 are brought into contact with both faces of the lens 1 when the lens unit 4 is elevated. The lens unit 4 is elevated or lowered in accordance with the data of the shape of the lens frame while the lens-holding shaft is rotated and the displacements of the styluses 60 and 61 in the axial direction are detected by linear scales or the like that are not shown in the Figure.

For processing the lens 1, starting from the condition shown in FIG. 2, the lens unit 4 is lowered after the main rotating tool 50 is rotated and the peripheral portion (the outer peripheral portion) of the lens 1 is ground into the prescribed shape by elevating or lowering the lens unit 4 in accordance with the shape data of the lens frame while the lens-holding shaft 41 is rotated.

By elevating or lowering the lens unit 4, based on the shape data of the lens frame corresponding to the rotation angle of the lens-holding shaft 41, continuous grinding is conducted to a processing depth in accordance with the rotation angle of the lens 1. During processing, the force of pressing the lens 1 to the main rotating tool 50 (the processing pressure) is provided by the weight of the lens unit 4 itself. The adjustment of the load in accordance with the material of the lens is conducted by supporting a portion of the weight of the lens unit 4 by a unit for controlling the load 8 disposed at a position above the lens unit 4.

The position of contact between the lens 1 and the main rotating tool 50 is changed by displacing the base unit 2 in the direction of the X-axis in FIG. 1 and selection between the flat grinding and the beveled grinding can be made. Switching between the rough grinding and the finishing grinding can also be made similarly.

A finishing unit 7 (a means for finishing) which comprises a rotating tool for chamfering 70 and a rotating tool for grooving 71 and can be displaced in the direction of the Y-axis (in the inner direction of the apparatus) is disposed at a position above the lens unit 4. When the finishing unit 7 is at the advanced position, the rotating tool for chamfering 70 and the rotating tool for grooving 71 are placed at a position directly above the lens-holding shaft 71. The selection between the rotating tools 70 and 71 is made and the position of the processing is set by elevating the lens unit 4 and driving the base unit 2 in the direction of the X-axis. Finishing is conducted in this condition.

The portions of the apparatus according to the illustrative embodiment will be described in more detail as follows.

Main Shaft Unit

Figure 3:
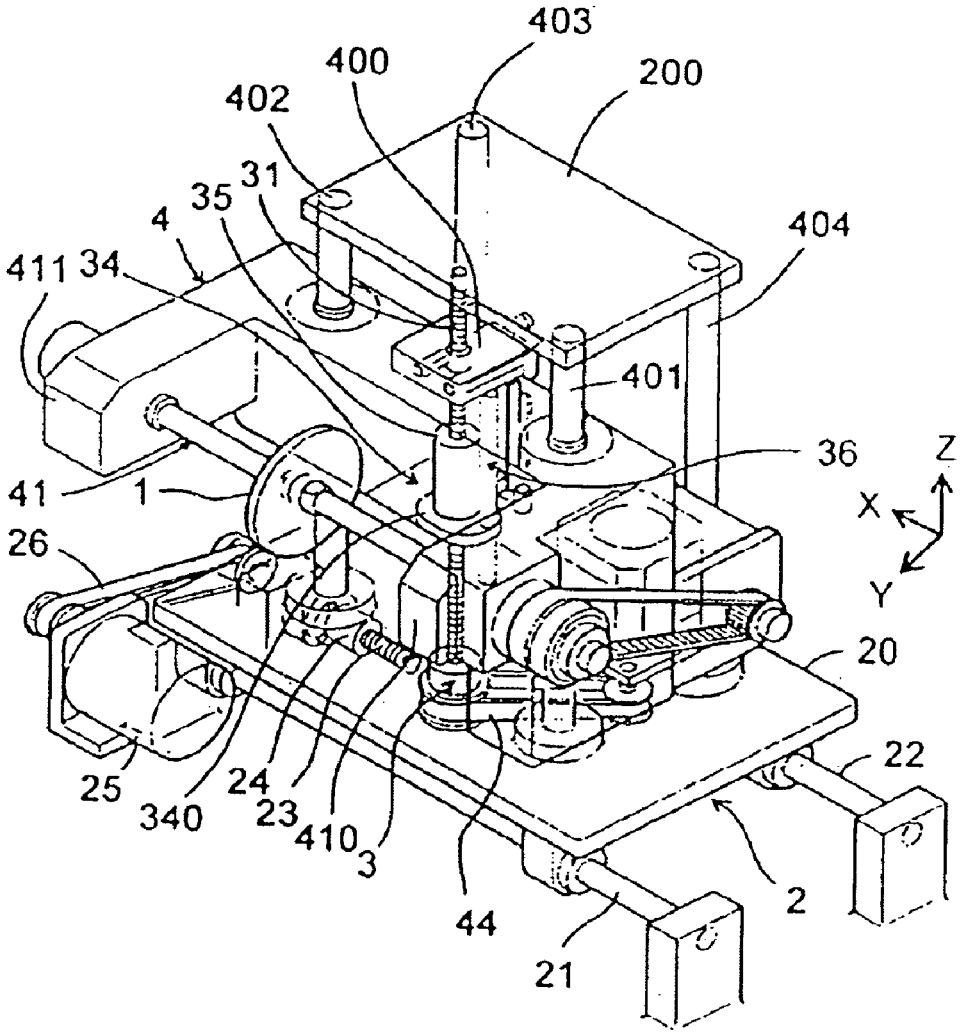
FIG. 3 shows a perspective view exhibiting the inner construction of the apparatus of an embodiment of present invention with the measuring unit and the finishing unit removed.

In FIGS. 2 and 3, the main shaft 51 on which the rotating tool (a grinder or a cutter having diamonds or the like) 50 is disposed and a motor 55 for driving the main shaft 51 are fixed to the base plate 15 inside of the case 11. The main shaft unit comprises these members as main components.

The main shaft 51 is, as shown in FIG. 2, supported by a shaft on the base plate 15 along the X-axis in a manner such that the main shaft 51 can be rotated freely and is disposed parallel to the lens-holding shaft 41.

At an end portion of main shaft 51, a main rotating tool 50 for mechanically processing, the lens 1 is attached. The main rotating tool 50 is placed at the central portion in the direction of the X-axis in FIG. 2 and at the front side of the apparatus (at the lower left side in FIG. 2). The base end portion of the main shaft (at the right side in FIG. 2) is driven by a motor 55 via a belt 57 and pulleys.

In the main rotating tool 50 that mechanically processes the lens 1, as shown in FIG. 2, a rough grinder 50*a*, a finishing grinder for flat grinding 50*b*, a finishing grinder for beveled grinding 50*c* and a grinder for mirror finishing 50*d* are disposed successively from the side of the tip of the main shaft 51 (the left side in the Figure). Depending on the material of the lens 1, an electrodeposited diamond wheel or a sintered diamond wheel, for example, is used as the rough grinder 50*a*, a sintered diamond wheel, for example, is used for the finishing grinder for flat grinding 50*b* and the finishing grinder for beveled grinding 50*c*, and a sintered diamond wheel, for example, is used for the grinder for mirror finishing 50*d*. The types and the positions of these grinders can be suitably exchanged with each other by detachment and attachment.

Base Unit

A base unit 2 for driving the lens unit 4 in the direction of the X-axis is disposed at a position inside the main shaft 51 in FIG. 2 (in the direction of the Y-axis, at the right side in FIG. 2).

As shown in FIG. 3, the base unit 2 comprises a base 20 that can be displaced in the direction of the X-axis, and a servomotor 25 (hereinafter, referred to as an X-axis motor) that controls positioning by driving the base 20 in the direction of the X-axis.

The base 20 is disposed on guide members 21 and 22, which are fixed on the base plate 15 in the direction of the X-axis so that the base 20 can be freely displaced. Therefore, the base 20 can be freely displaced in the direction of the X-axis.

In FIG. 3, an inner screw 23 is disposed at a position below the base 20 between the guide members 21 and 22 so that the inner screw 23 can be rotated freely. An outer screw 24 fixed at the lower face of the base 20 is engaged with the inner screw 23 and the base 20 is driven in the direction of the X-axis by rotation of the screw 23.

One end of the inner screw 23 and the X-axis motor 25 are connected to each other via a gear and a cogged belt 26 and the base 20 is positioned in the direction of the X-axis in accordance with the rotation angle of the X-axis motor 25.

Elevating and Lowering Unit

Figure 5:
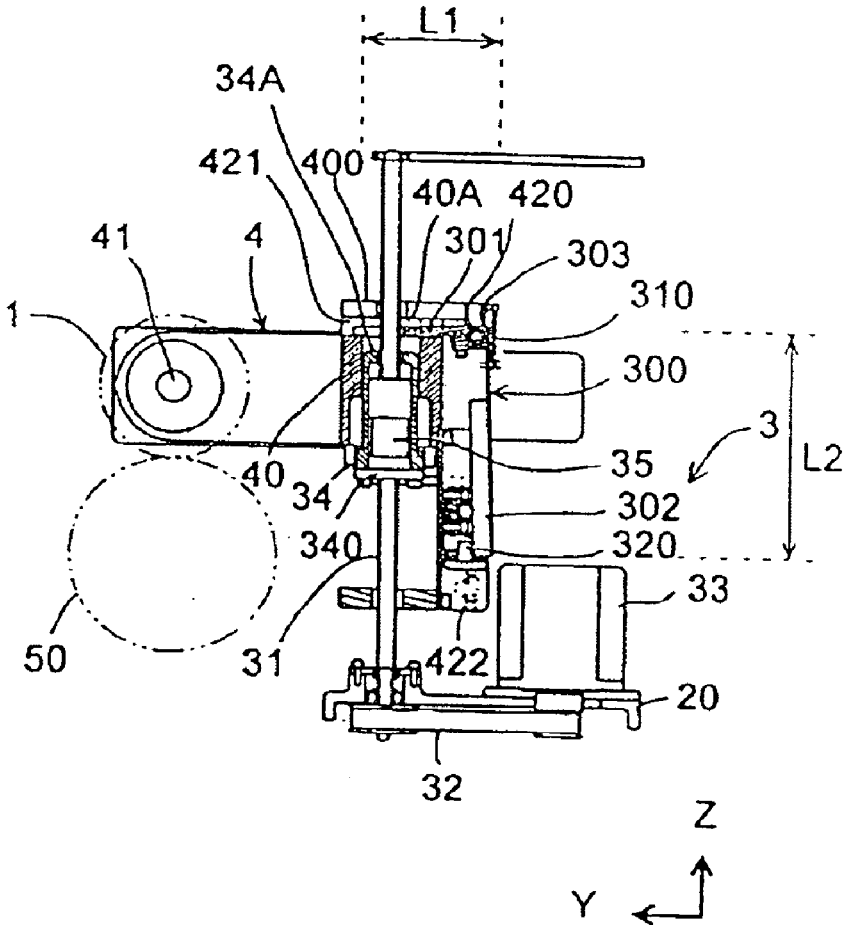
FIG. 5 shows a sectional view of the elevating and lowering unit and the lens unit in the vertical direction when the processing is started.

As shown in FIGS. 3 and 5, for example, two poles 401 and 402 stand on the base 20, penetrate a frame 40 of the lens unit 4 and guide the lens unit 4 in the vertical direction (the direction of the Z-axis) so that the lens unit 4 can be displaced freely.

As shown in FIGS. 3 and 5, the lens unit 4 is driven in the vertical direction and positioned in the vertical direction by the elevating and lowering unit 3, which is displaced in the direction of the Z-axis. The lens unit 4 is positioned in the direction of the X-axis by the base unit 2. The lens unit 4 supporting the lens 1 is driven in the directions of the X-axis and the Z-axis relative to the main shaft 51.

The elevating and lowering unit 3 comprises, as shown, for example, in FIGS. 3, 4 and 5, a screw 31 that is supported by a shaft on the base 20 between the poles 401 and 402 and that penetrates the frame 40 of the lens unit 4 in the vertical direction, a positioning member 34 that is engaged with the screw 31 at an inner peripheral portion and can support the lens unit 4 by contacting the frame 40 of the lens unit 4 at the upper end, and a servomotor 33 (hereinafter, referred to as a Z-axis motor) that is connected to the lower end of the screw 31 via a cogged belt 32 and a gear. The elevating and lowering unit 3 is disposed on the base 20.

In the elevating and lowering unit 3, the screw 31 is rotated by driving the Z-axis motor 33. The positioning member 34 having an outer screw 35 engaged with the screw 31 is thus driven in the direction of the Z-axis. The outer screw 35 is displaced in the direction of the Z-axis since the rotating movement in the circumferential direction is restricted by a mechanism on the lens unit 4, as shown later.

As shown in FIG. 5, the positioning member 34 contacts the inner periphery of a hole portion 40A formed in the frame 40 of the lens unit 4 in the vertical direction in a manner such that the positioning member 34 can slide and make a relative displacement in the vertical direction.

Figure 6:
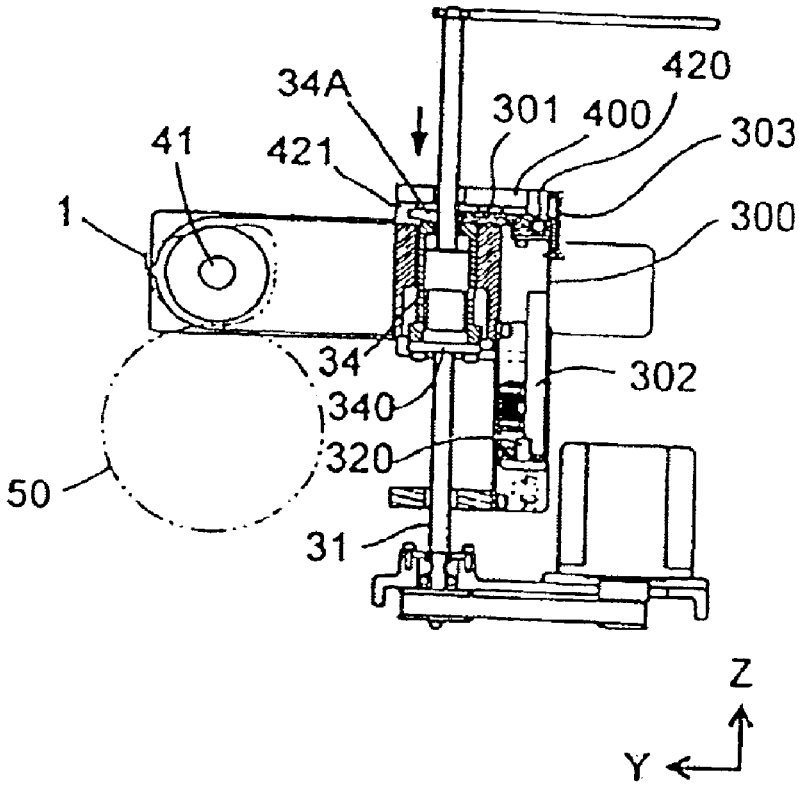
FIG. 6 shows a sectional view of the elevating and lowering unit and the lens unit in the vertical direction when the processing is completed.

At the upper end of the hole portion 40A, a ceiling portion 400 connected to the frame 40 is disposed. As shown in FIGS. 3 and 6, at the side of the outer screw 35 of the positioning member 34, a stopper 36 standing in the direction of the Z-axis is disposed so that the stopper 36 can contact the lower face of the ceiling portion 400.

In FIG. 3, the stopper 36 protruding from the upper portion of the positioning member 34 contacts the lower face of the ceiling portion 400 and the load of the lens unit 4 applied by the ceiling portion 400 is supported by the positioning member 34 comprising the stopper 36 and the outer screw 35. The outer screw 35 and the stopper 36 are connected to each other at each base portion through a base 340.

As shown in FIGS. 5 and 6, the hole portion 40A of the frame 40 has a sectional shape such that the positioning member 34 and the stopper 36 are stopped by each other around the Z-axis (in the direction perpendicular to the plane of FIG. 6) and the idle rotation of the outer screw 35 by the rotation of the screw 31 is prevented. In other words, the stopper 36 fixed at the side of the outer screw 35 is arrested by the hole portion 40A and the rotation of the positioning member 34 is prevented. Thus, the outer screw 35 is elevated or lowered by the rotation of the screw 31 and the positioning member 34 is displaced in the direction of the Z-axis due to this movement.

When the stopper 36 does not contact the ceiling portion 400, as shown in FIG. 5, the lens 1 supported by the lens unit 4 is brought into contact with the main rotating tool 50 and the weight of the lens unit 4 itself is applied as the load. The upper end face 34A of the positioning member 34 and the lower face of the ceiling portion 400 do not contact each other and a prescribed gap is formed.

At a position below the ceiling portion 400 facing the gap, a hole portion 421, where one end of a sensor arm 300 (a means for amplifying a relative displacement) for detecting completion of the processing of the lens unit (in the vertical direction) is inserted, is disposed along the Y-axis in the Figure in a manner such that the hole portion 421 penetrates the frame 40 across the hole portion 40A.

The sensor arm is, as shown in FIGS. 5 and 6, an integrally formed arm having the shape of an inverse L which is composed of an arm 301 extending to the left side in the Figures (in the direction of the Y-axis) and inserted into the hole portion 421 and an arm 302 extending in the lower direction in the Figure (in the direction of the Z-axis, to the side of the base 20). The arm 301 and the arm 302 are disposed approximately perpendicularly to each other. The length of the arm 302 in the vertical direction is set longer than that of the arm 301 in the horizontal direction.

A bending portion 303 at the middle of the sensor arm 300 having the shape of an inverse L is supported by a shaft 420 disposed at the ceiling portion 400 of the lens unit 4 in a manner such that the bending portion 303 can freely swing around the shaft 420 and, therefore, the sensor arm can swing around the X-axis.

Between the arm 302 extending in the direction of the Z-axis and the ceiling portion 400, a spring 310 is disposed that pushes the arm 301 extending in the direction of the Y-axis in the lower direction in FIGS. 5 and 6 (in the counter-clockwise direction in the Figures).

Since the arm 301 inserted into the hole portion 421 crosses the hole portion 40A in the direction of the Y-axis, a penetrating portion through which the screw 31 is inserted is formed and the lower face of the arm 301 facing the inner periphery of the hole portion 40A can be brought into contact with or separated from the upper end face 34A of the positioning member 34.

Since the sensor arm 300 is pushed in the counter-clockwise direction in the Figures by the spring 310, as shown in FIG. 5, the tip 301A of the arm 301 is brought into contact with the lower side of the hole portion 421 and stopped there in the condition that the upper end face 34A of the positioning member 34 and the arm 301 are separated from each other (in the condition that the stopper 36 is separated from the ceiling 400).

On the other hand, as shown in FIG. 6, when the stopper 36 of the positioning member 34 contacts the ceiling portion 400 of the lens unit 4 (in the condition that the stopper 36 contacts the ceiling portion 400 as shown in FIG. 3), in other words, when the positioning member 34 supports the lens unit 4, the upper end face 34A of the positioning member 34 pushes the arm 301 in the upper direction. In this condition, the sensor arm 300 rotates and the arm 302 extending in the direction of the Z-axis is placed at the prescribed position (for example, a position in the vertical direction as shown in FIG. 6).

A bracket 422 protruding along the lower portion of the sensor arm 300 (the arm 302) is disposed at the frame 40. At a prescribed position of the bracket 422 that faces the lower end of the arm 302 swinging around the X-axis, a sensor is disposed for detecting completion of the processing (a means for detection) 320. The sensor detects the free end portion of the arm 302 swinging around the X-axis. The free end portion means the end portion of the sensor arm 300 that is detected by the sensor for detecting completion of the processing 320 and, in the present embodiment, is the end portion of the arm 302.

The sensor for detecting completion of the processing 320 comprises, for example, a photosensor such as a photointerruptor. As shown in FIG. 6, when the swinging arm 302 comes to the prescribed position (the position in the vertical direction where the lens unit 4 and the positioning member 34 are brought into contact with each other) and the light of the photointerruptor of the sensor for detecting completion of the processing is interrupted, the sensor is switched at ON and it is detected that the processing has been completed.

The elevating and lowering unit 3 supports the lens unit 4 in the elevating direction. After the lens unit 4 starts the processing of the lens 1, the processing depth (the processing amount) is decided in accordance with the position of the elevating and lowering unit 3 in the direction of the Z-axis. When the prescribed processing depth is achieved, the sensor for detecting completion of the processing 320 is switched at ON. The proceeding of the processing can be detected at every rotation angle of the lens 1 in this manner and, when the output of the sensor for detecting completion of the processing at the entire peripheral portion of the lens 1 shows ON, it is decided that the processing has been completed on the entire peripheral portion of the lens 1.

Since the relative distance between the position of the lens unit 4 in the vertical direction and the position of the positioning member 34 in the vertical direction (the processing depth) is amplified by the lever ratio described above in the swing of the arm 302, the sensor for detecting completion of the processing 320 detects, with great accuracy, that the prescribed processing depth has been reached. As described above, the elevating and lowering unit 3 supports the lens unit 4 in the direction of elevation and, after the processing of the lens 1 has been started by the lens unit 4, the processing depth (the processing amount) is decided in accordance with the position of the elevating and lowering unit 3 in the direction of the Z-axis.

Lens Unit

Figure 7:
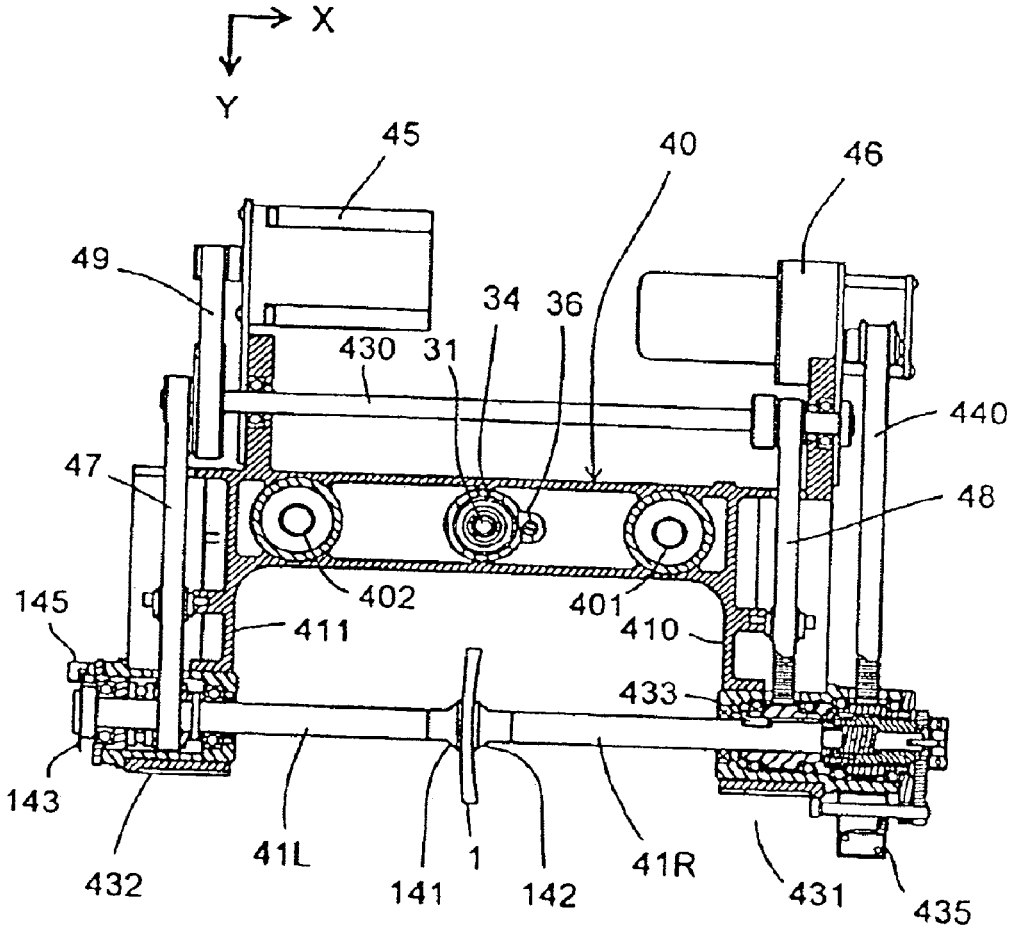
FIG. 7 shows a sectional view of the elevating and lowering unit and the lens unit in the horizontal direction when the lens is held by the lens-holding shafts.

The lens unit 4 is displaced by the elevating and lowering unit 3 in the direction of the Z-axis is, as shown in FIGS. 2 and 7, and guided by the two poles 401 and 402 standing on the base 20 in the vertical direction (in the direction of the Z-axis). In this manner, the lens unit can be freely displaced. The lens unit comprises the lens-holding shaft 41 that is divided into two portions, a motor for driving the lens 45 that rotates the lens-holding shaft 41, and a motor for the lens chuck 46 that changes the pressure of the lens-holding shaft 41 to hold the lens 1.

As shown in FIG. 4, the lens-holding shaft 41 that holds and rotates the lens 1 is placed at a position directly above the main rotating tool 50. The direction connecting the axial line of the lens-holding shaft 41 and the axial line of the main shaft 51 is in the vertical direction.

As shown in FIGS. 2 and 7, arms 410 and 411 protruding from the frame 40 of the lens unit 4 in the direction of the front of the apparatus (to the lower left side of FIG. 2). Frame 40 and the arms 410 and 411 form a rectangle having three sides and open on one side. The arms 410 and 411 support the lens-holding shaft 41.

Figure 8:
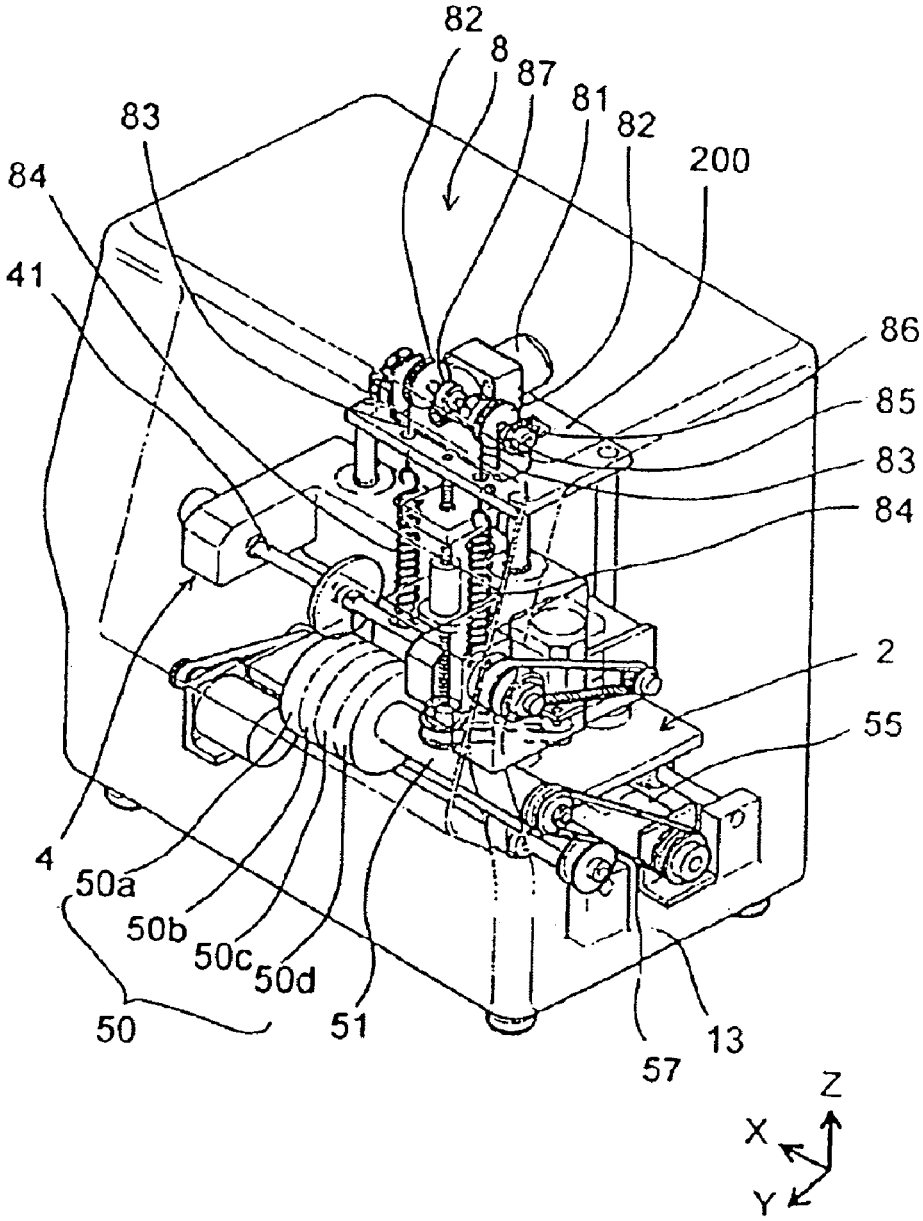
FIG. 8 shows a perspective view exhibiting the relation between the unit for controlling the load and the lens unit.

In FIGS. 3 and 8, the lens-holding shaft 41 is divided into two portions at the center, i.e., a shaft 41R supported by the arm 410 and a shaft 41L supported by the arm 411. The arm 41L is supported by the arm 411 at the left side in FIG. 8 so that the arm 41L is freely rotateable. The arm 41R is supported by the arm 410 at the right side in FIG. 8 so that the arm 41L is freely rotateable and can be displaced in the axial direction (in the direction of the X-axis).

The shafts 41L and 41R are rotated by the motor 45 for driving the lens via cogged belts 47, 48 and 49. The cogged belts 47 and 48 are connected to each other through a shaft 430 and the rotation angles of the shafts 41L and 41R are synchronized.

For this purpose, a gear 432 engaged with the cogged belt 47 is fixed to the shaft 41L and a gear 431 engaged with the cogged belt 48 is fixed to the shaft 41R. So that the shaft 41R can be displaced relative to the arm 410 in the direction of the X-axis, the shaft 41R is arrested in the direction of rotation by the key 433 disposed between the shaft 41R and the inner periphery of the gear 431 and, on the other hand, can be relatively displaced in the direction of the X-axis.

In FIG. 7, a chuck mechanism driven by a motor for the lens chuck 46 is disposed at the end portion (at the right side in FIG. 7) of the shaft 41R.

Then, to decide the processing depth in accordance with the rotation angle of the lens 1, the shaft 41L penetrates the arm 411 and a slit plate 143 is fixed at the end portion protruding from the arm 411. By detecting the position of rotation of the slit plate 143 by a photosensor 145 (a lens position sensor, or a means for detecting the angle) fixed to the arm 411, the position (the rotation angle) of the lens 1 held by the lens-holding shaft 41L is detected.

Figure 9:
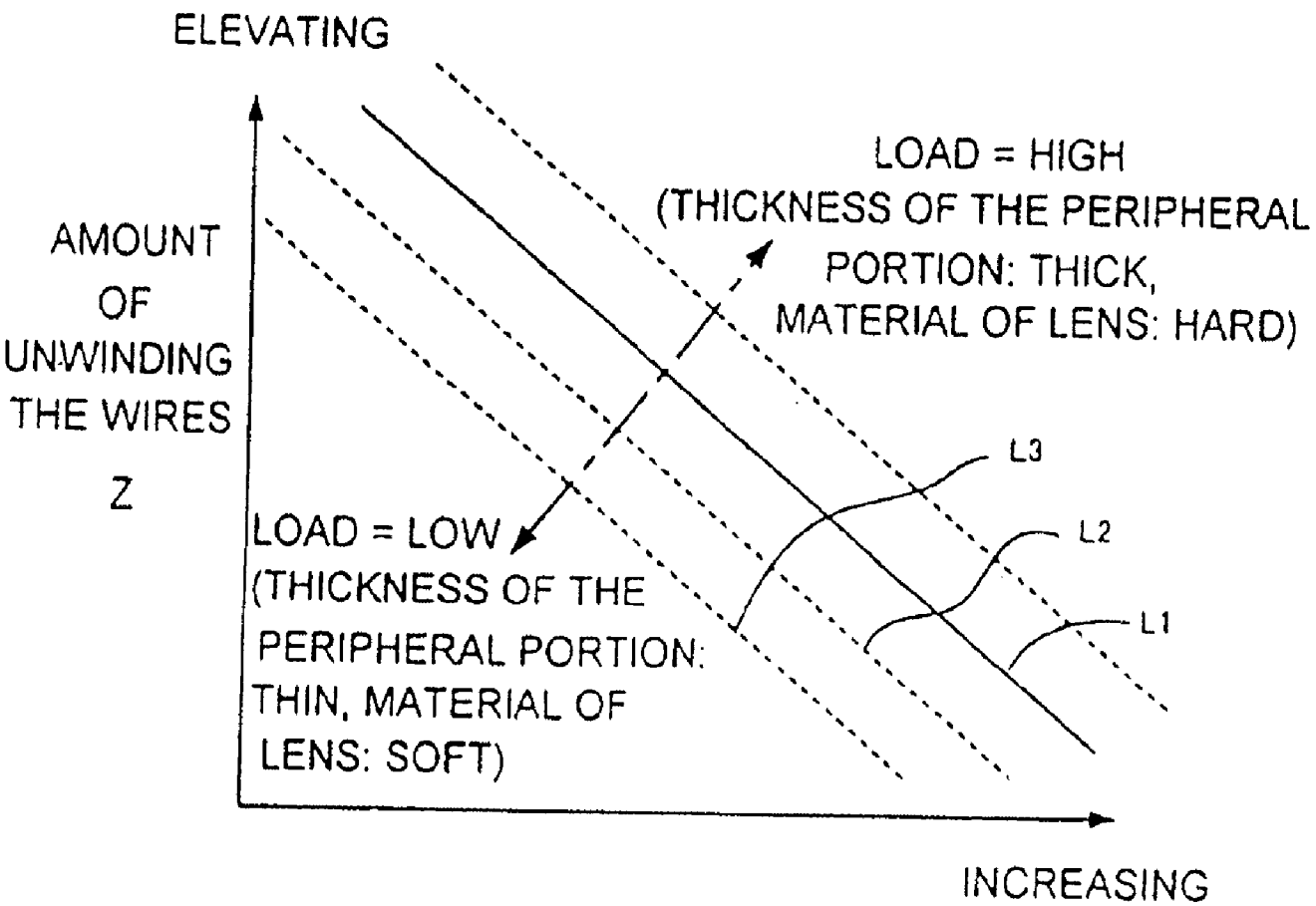
FIG. 9 shows a table describing the relationship between the amount of unwinding the wire and the position of the lens unit using the load as a parameter.

In the lens unit 4 having the construction described above, when the lens 1 is fixed at the receiver of the lens holder 141, the motor for the lens chuck 46 is driven and the lens-holding shaft 41R is moved to the left side of FIG. 9. The lens 1 is fixed by pressing the lens 1 by the lens presser 142 under pressure.

When the lens 1 is processed or when the finished position of the peripheral portion of the lens 1 is measured, the lens-holding shaft 41L and 41R are rotated by driving the motor for driving the lens 45 and the lens 1 is rotated.

As shown in FIG. 2, the main rotating tool 50 is fixed to the base plate 15 and is not displaced. The lens 1 supported by the lens unit 4 is displaced in the vertical direction relative to the main rotating tool 50 by the displacement of the elevating and lowering unit 3 in the direction of the Z-axis and the processing can be conducted to the desired depth.

The position of the lens 1 for the processing can be changed by changing the rotation angle of the motor for driving the lens 46 and the peripheral portion of the lens 1 can be processed to the desired processing depth.

The tool used for the processing can be changed by changing the position of contact between the lens 1 and the main rotating tool 50 by the displacement of the base 20 in the direction of the X-axis.

Unit for Controlling the Load

The unit for controlling the load (for adjusting the load) 8 for controlling the pressure of pressing the lens 1 supported by the lens unit 4 to the main rotating tool 50 will be described.

The unit for controlling the processing pressure 8 is, as shown in FIGS. 4 and 8, fixed on an upper base 200 which is disposed at upper ends of poles 401 to 404 standing on the base plate 2 and is displaced in the direction of the X-axis in combination with the lens unit 4.

In FIGS. 4 and 8, the unit for controlling the load 8 comprises pulleys 82 and 82 driven by a motor for controlling the load 81 (an actuator), wires 83 wound around the pulleys 82, and springs (an elastic member) 84 connecting the wires 83 to the frame 40 of the lens unit 4. The motor for controlling the load 81 and the pulleys 82 and 82 are connected to each other via a worm gear 87.

In FIG. 8, the lens unit 4 is suspended with pairs of pulleys 82 (winding members), the wires 83 (suspending members) and the springs 84. The numbers of the wire 83 and the spring 84 can be selected as desired.

The force of pressing the lens 1 to the main rotating tool (the load, the pressure of grinding) is the weight of the lens unit 4 itself. However, since it is necessary that the load (the surface pressure) be changed in accordance with the material of the lens for processing (e.g., either a glass or a resin) and the thickness of the peripheral portion, a portion of the weight of the lens unit 4 is supported by the tension of the springs 84 and the load of the lens unit 4 applied to the lens 1 is thus adjusted.

Since the lens is processed while the lens unit 4 is displaced vertically, it is necessary that an approximately constant load be applied independently of the position of the lens unit 4.

Therefore, the amount of unwinding the wires 83 is adjusted by the motor for controlling the load 81 in accordance with the displacement of the lens unit in the direction of the Z-axis so that the tension of the springs 84 is held approximately constant.

In FIG. 8, the amount of unwinding the wires 83 is controlled in accordance with the rotation angle and the number of rotation of the pulleys 82 which are detected by the slit plate 85 disposed coaxially with the pulleys 82 and a photosensor 86 detecting the passage of the slit.

As the position of the lens unit 4 in the direction of the Z-axis, the amount of driving the Z-axis motor 42 (for example, the output of the encoder in the case of a servomotor and the number of steps in the case of a step motor) or a value obtained by directly measuring the position of the lens unit 4 or the lens-holding shaft 41 along the Z-axis can be used.

As for the relation between the amount of unwinding the wires 83 (or the amount of driving the motor for controlling the load 81) and the load applied to the lens 1, the tension of the springs 84 decrease and the load increases as the amount of unwinding the wires 83 increases, and the tension of the springs 84 increases and the load decreases as the amount of unwinding the wires 83 decreases.

As for the relation between the position of the lens unit 4 in the direction of the Z-axis and the amount of unwinding the wires 83, the amount of unwinding can be decreased as the lens unit is elevated at a higher position and the amount of unwinding the wires 83 can be increased as the processing by the lens unit 4 proceeds using a linear table or the map shown in FIG. 9.

Since the required load varies depending on the material and the thickness of the peripheral portion of the lens 1 as described above, as will be described later, the load can be selected based on a plurality of properties shown in FIG. 9. These properties include material input data and the thickness of the peripheral portion of the lens or the relationship between the amount of unwinding and the position of the lens unit 4 (a proportional relationship obtained by calculation).

Since the thickness of the peripheral portion varies depending on the position of processing, different properties may be selected in accordance with the rotation angle of the lens-holding shaft 41 (the position of processing the lens).

Figure 13:
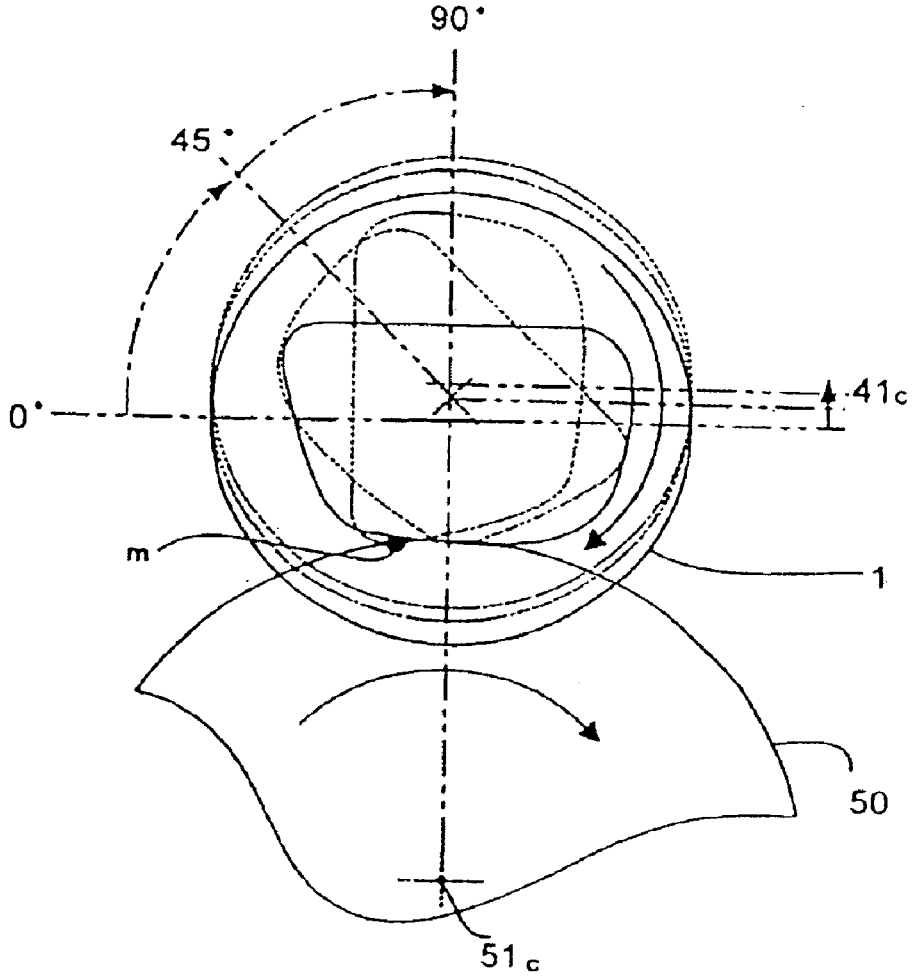
FIG. 13 shows an expanded view of the lens and the main rotating tool during the processing.

The position of the lens unit in the direction of the Z-axis is decided by the elevating and lowering unit 3 described above. As shown in FIG. 13, since the processing is conducted while the lens 1 supported by the lens-holding shaft 41 is rotated, the position in the direction of the Z-axis always changes. As shown in FIGS. 5 and 6, the position of the lens unit 4 at the start of the processing is different from that at the end by the processing depth.

When the amount of unwinding the wires 83 is controlled in accordance with the change in the rotation angle of the lens 1 or the processing depth, the control and the mechanism become complicated due to the detection of the actual position of processing.

By disposing springs 84 between the wires 83 and the frame 40 of the lens unit 4, the load close to the set value can be maintained by the change in the length of the springs 84 even when the amount of unwinding the wires 83 cannot follow the change in the position of the lens unit 4. Therefore, the load of calculation required for the control can be decreased remarkably.

G. Cooling Unit

The cooling unit for supplying a cooling liquid during the processing of the lens will be described as follows. The cooling unit is used for cooling the uncut lens 1 and the tools and removes dust and debris of grinding. In the present embodiment, a cooling liquid comprising water as a main component is used.

Figure 10:
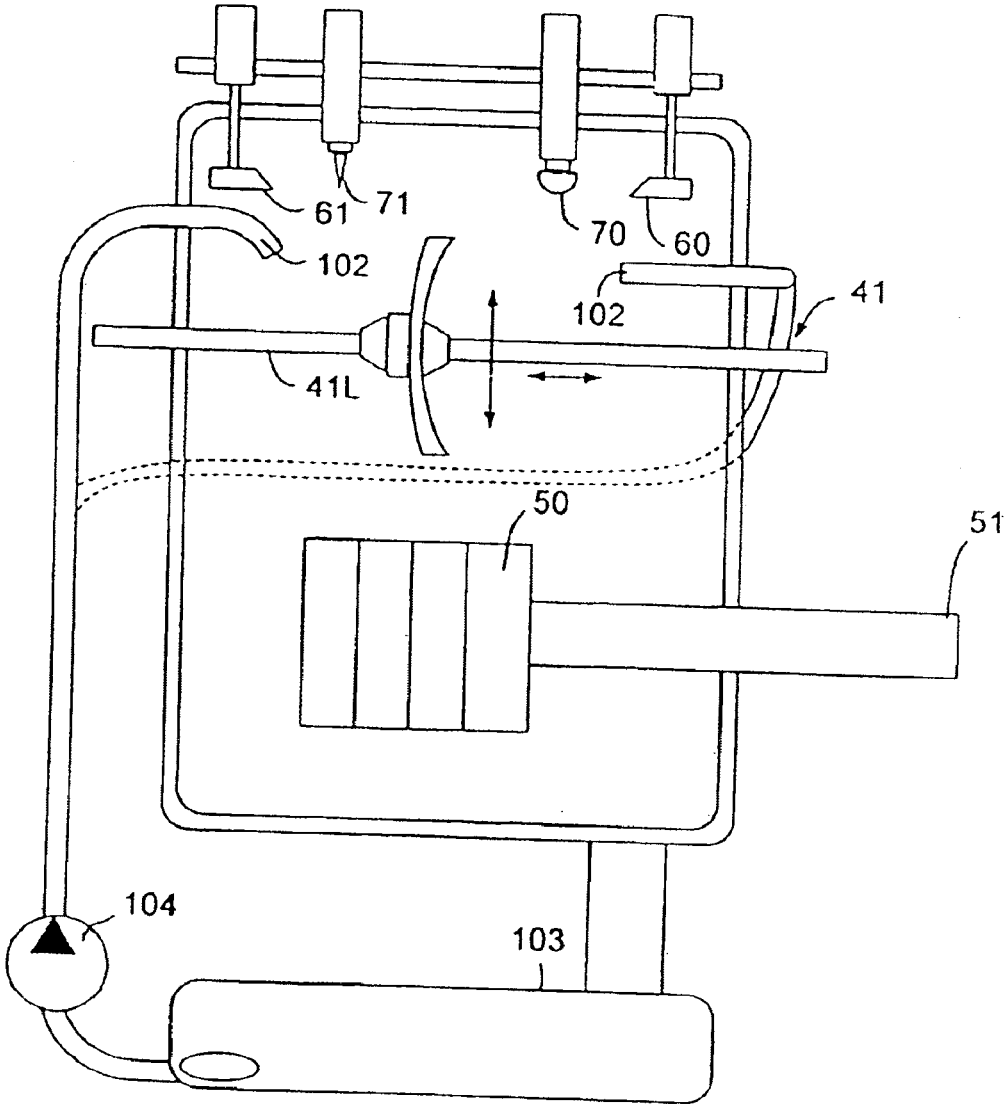
FIG. 10 shows a schematic front view of the cooling unit of an embodiment of present invention.

The cooling unit comprises, as shown in FIGS. 10 and 2, a waterproof case 101 that has the shape of a box and surrounds the main rotating tool 50, the lens 1 supported by the lens-holding shaft 41, the styluses 60 and 61 and the rotating tools 70 and 71 of the finishing unit 7, a nozzle 102 injecting the cooling liquid to the vicinity of the lens 1 held by the lens-holding shaft 41, a tank 103 disposed at a position below the waterproof case 101, and a pump 104 sending the cooling liquid in the tank 103 to the nozzle 102 under a pressure.

On the waterproof case 101, a door 14 which can be opened and closed is disposed (refer to FIG. 1). When the door 14 is opened, the lens is attached or detached. When the door is closed, the inside of the waterproof case 101 is tightly closed and wetting of the bearing of the main shaft 51, the motors, the power source and the electric circuits with the scattered cooling liquid injected in the waterproof case 101 is prevented.

The cooling liquid used for cooling the lens 1 and the rotating tools during the processing returns to the tank 103, is sucked into the pump 104 and circulated. Since the cooling liquid used for cooling the lens 1 contains dust and debris formed by processing the lens 1, a drain which can be opened and closed is attached to the tank 103, so that the dust and debris formed by cutting can be removed and the cooling liquid can be exchanged with the fresh cooling liquid.

H. Control Unit

Figure 11:
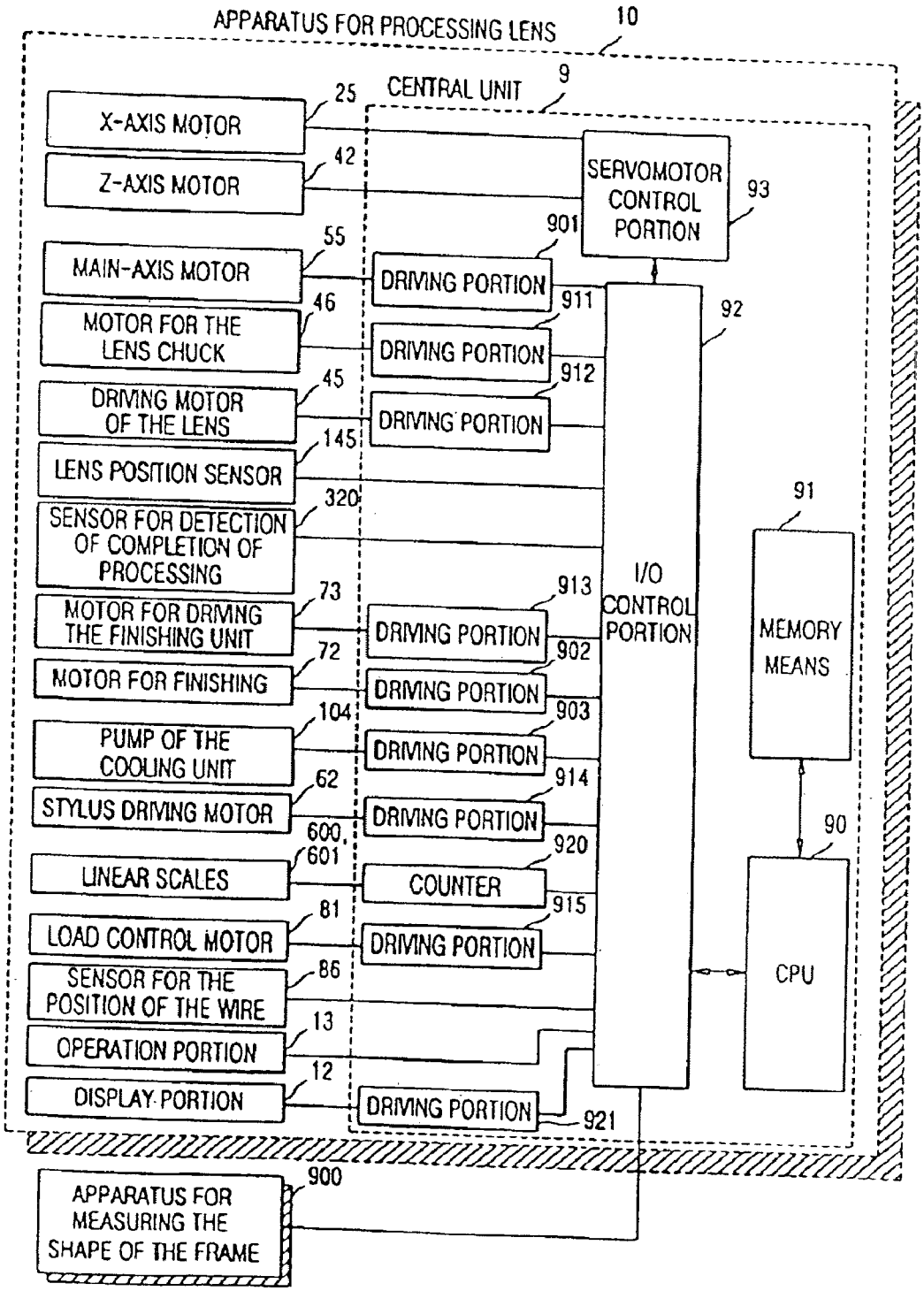
FIG. 11 shows a schematic diagram exhibiting the control portion of an embodiment of present invention.

The apparatus for processing a lens 10 comprises the various mechanisms (units) described above and further has a control portion 9 for controlling the mechanisms as shown in FIG. 11.

In FIG. 11, the control portion 9 comprises a microprocessor (CPU) 90, a means for memory (a memory, a hard disk and the like) 91, and an I/O control portion (an interface) 92 connected to the motors and the sensors. The control portion 9 reads the shape data of the lens frame sent from the apparatus for measuring the shape of the frame 900 placed at the outside. The control portion 9 also reads, the data from various sensors and drives the various motors so that the prescribed processing is conducted based on the properties (the material, the hardness and the like) of the lens 1 set by the operation portion 13. As the apparatus for measuring the shape of the frame, an apparatus such as the apparatus disclosed in Japanese Patent Application Laid-Open No. Heisei 6(1994)-47656 can be used.

The control portion 9 comprises a servomotor control portion 93 that positions the lens unit 4 in the directions of the X-axis and the Z-axis by driving the X-axis motor 25 of the base unit 2 and the Z-axis motor 42 of the elevating and lowering unit 3.

The motor 55 for driving the main rotating unit 50, the motor for finishing 72 which drives the rotating tools 70 and 71 and the pump 104 of the cooling unit are each connected to the I/O control portion 92 via driving portions 901, 902 and 903, respectively, and the condition of rotation or the speed of rotation is controlled in accordance with the direction from the microprocessor 90. The driving portion 901 of the motor 55 of the main shaft is constituted, for example, with an inverter and the main rotating tool 50 is driven at the desired speed of rotation.

The motor for the lens chuck 46 that controls the holding pressure applied to the lens 1 by changing the length of the shaft 41R of the lens-holding shaft 41 is connected to the I/O control portion 92 via a driving portion 911 which controls the holding pressure in accordance with the electric current of driving.

The motor 45 for driving the lens is connected to the I/O control portion 92 via a driving portion 912 which controls the rotation angle of the lens-holding shaft 41 (the lens 1). The microprocessor 90 directs the position of processing the lens 1 based on the data of the shape of the lens frame obtained from the apparatus for measuring the shape of the frame 900, detects the rotation angle of the lens 1 by the sensor for detecting the position of the lens 145 and drives the Z-axis motor 42, so that the processing depth in accordance with the rotation angle based on the shape data of the lens frame is achieved.

When the prescribed processing depth is achieved, a sensor for detecting completion of processing 320, which will be described later, is switch at ON and the actual position of processing is fed back to the microprocessor 90.

The motor for driving the finishing unit 73 that drives the finishing unit 7 in the direction of the Y-axis, the motor for driving styluses 62 that drives the styluses 60 and 61 of the measuring unit 6, and the motor for controlling the processing pressure 81 of the unit for controlling the load 9 are each connected to the I/O control portion 92 via driving portions 913, 914 and 915, respectively, which control the positioning.

The outputs of linear scales 600 and 601 connected to the styluses 60 and 61, respectively, of the measuring unit 6 are input into a counter 920. The microprocessor 90 reads the values in the counter 920 and measures the position of the peripheral portion (the position of the finished portion) of the lens 1.

A photosensor 86 (a sensor for the position of the wire) of the unit for controlling the load 8 detects the rotation angle of the pulley 82. The microprocessor 90 drives the motor for controlling the load 81 in a manner such that the load set in accordance with the position of the lens unit 4 in the direction of the Z-axis is maintained.

The operation portion 13 disposed at the front of the cover of the apparatus for processing a lens 10 is connected to the I/O control portion 92 and transfers the directions from the operator (the material of the lens 1 and the processing with or without the beveled processing or the grooving) to the microprocessor 90. The microprocessor 90 outputs the response to the directions and the information of the content of the processing to the display portion 12 via the driving portion 921.

An embodiment of the operation portion 13 and the content of the processing will be described as follows.

Figure 12:
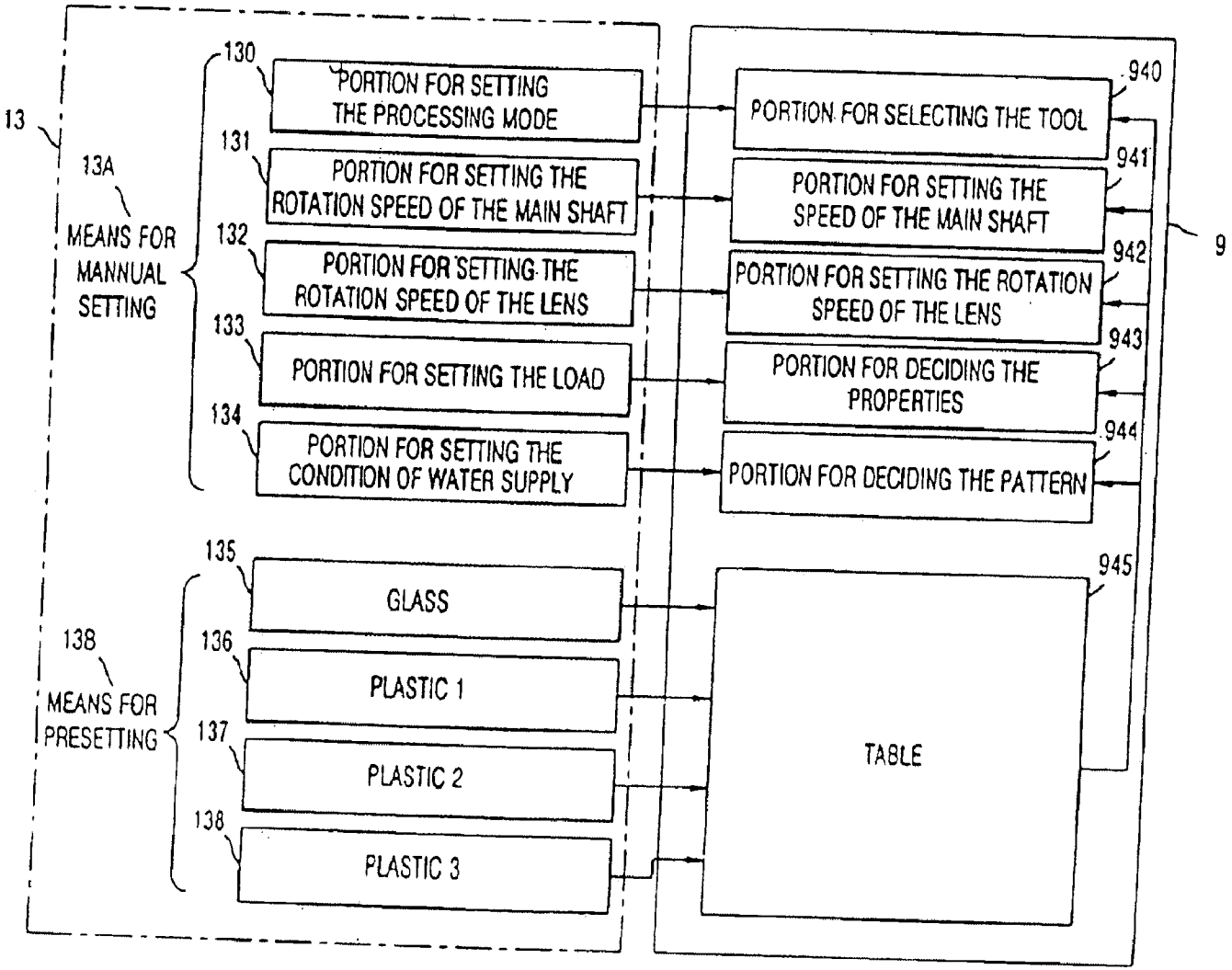
FIG. 12 shows a block diagram exhibiting the operation portion and the control portion.

FIG. 12 shows a block diagram exhibiting the function of the operation portion 13 and the control portion 9. The operation portion 13 comprises a means for manual setting 13A for manually setting the conditions of the processing and a means for presetting 13B in which the conditions of the processing set in advance are classified with respect to the material.

The means for manual setting 13A comprises a portion for setting the processing mode 130 that selects the step of the processing from steps such as rough processing, finishing (the flat finishing or the, beveled finishing) and mirror finishing (the flat mirror finishing or the beveled mirror finishing), a portion for setting the rotation speed of the main shaft 131 which sets or selects the rotation speed of the main shaft 51, a portion for setting the rotation speed of the lens 132 which sets or selects the rotation speed of the lens-holding shaft 41, a portion for setting a load 133 which sets or selects the load (kgf) applied to the lens 1 by the lens unit 4 and a portion for setting the condition of water supply 134 which sets or selects the condition of the use of the cooling water.

At the portion for setting the processing mode 130, for example, one of rough processing, finishing (the flat finishing and the beveled finishing), mirror finishing (the flat mirror finishing and the beveled mirror finishing), chamfering and grooving is selected using ten keys or touch switches. The value set at the portion for setting the processing mode 130 is input into a portion for selecting the tool in the control portion 9 and the position of the lens unit 4 in the direction of the X-axis is set so that the lens 1 is placed at the position corresponding to the tool for the selected processing mode.

At the portion for setting the rotation speed of the main shaft 131, a desired rotation speed (rpm) is input using key input, for example, ten keys, or a desired rotation speed is selected from a plurality of speeds (such as high, medium and low) set in advance using touch switches. The value set at the portion for setting the rotation speed of the main shaft 131 is input into a portion for setting the rotation speed of the mains shaft 941 of the control portion 9 and the control parameter is, set so that the motor is controlled at the set value.

At the portion for setting the rotation speed of the lens shaft 132, a desired rotation speed (rpm) is input using keys or other input methods, or a desired rotation speed is selected from a plurality of speeds set in advance using touch switches. The value set at the portion for setting the rotation speed of the lens shaft 132 is input into a portion for setting the rotation speed of the lens 942 in the control portion 9 and the control parameter is set so that the motor for driving the lens 45 is controlled at the set value.

At the portion for setting the rotation speed of the lens shaft 132, the direction (positive or negative) of rotation of the lens-holding shaft 41 can also be set. For example, when the direction of the rotation is positive, the lens-holding shaft 41 and the main shaft 51 are rotated in the same direction and the grinding is conducted as an up cut and, when the direction of the rotation is negative, the lens-holding shaft 41 and the main shaft 51 are rotated in different directions and the grinding is conducted as a down cut. In the up cut, for example, as shown in FIG. 13, the lens-holding shaft 41 and the main shaft 51 are both rotated in the clockwise direction and the lens 1 and the rotating tool 50 at the main shaft 51 are displaced in different directions at the position of the grinding. In the down cut, the movements are reversed and the lens 1 and the rotating tool 50 at the main shaft 51 are displaced in the same direction at the position of the grinding.

At the portion for setting a load 133, a desired load (kgf) is input, or a desired load is selected from a plurality of loads (such as high, medium and low) set in advance using touch switches. The value set at the portion for setting a load 133 is input into a portion for deciding the properties 943 in the control portion 9 and the driving pattern of the motor for controlling the load 81 is set so that load is controlled at the set value as shown in FIG. 9.

At the portion for setting the condition of water supply 134, a pattern of water supply is selected from a plurality of patterns of water supply set in advance using touch switches. For example, a pattern of water supply is selected from no water supply at all (dry processing), continuous water supply (wet processing) and water supply started during the processing. The value set at the portion for setting the condition of water supply 134 is input into a portion for deciding the pattern 944 of the control portion 9 and the pattern of driving the pump 104 is set so that the water supply is controlled in accordance with the set pattern of water supply.

By the means for presetting 13B, the pattern of the processing is set in advance in accordance with the material of the lens 1. For example, there is provided a switch for selecting glass 135, a switch for selecting a generally used resin such as CR-39 136 (Plastic 1 in the Figure), a switch for selecting a hard resin for lenses such as polycarbonates 137 (Plastic 2 in FIG. 15) and a switch 138 for selecting a resin which produces melted dust and debris of grinding as described above (Plastic 3, in FIG. 15). When one of these switches 135 to 138 is selected, the rotation speed of the main shaft, the rotation speed of the lens shaft, the load and the pattern of water supply are set into a table 945 in the control portion 9 for every processing mode.

Fine adjustment can be made for each processing mode by selection using the means for manual setting 13A after one of the selection switches 135 to 138 in the means for presetting 13B has been pushed in accordance with the material of the lens.

The processing decided by the means for manual setting 13A or the means for presetting 13B can be started by pushing a starting button not shown in the Figure.

Although not shown in the Figures, the operation portion 13 may further comprise a portion for setting the chuck pressure, for setting the driving power of the motor for the lens chuck 46 and a portion for controlling the chuck pressure for setting the control parameters in accordance with a set value so that the pressure of holding the lens 1 can be changed as desired.

I. Outline of the Processing

The procedures of the processing by the apparatus for processing a lens 10 using the control portion described above will be described in the following with reference to FIG. 14.

Figure 14:
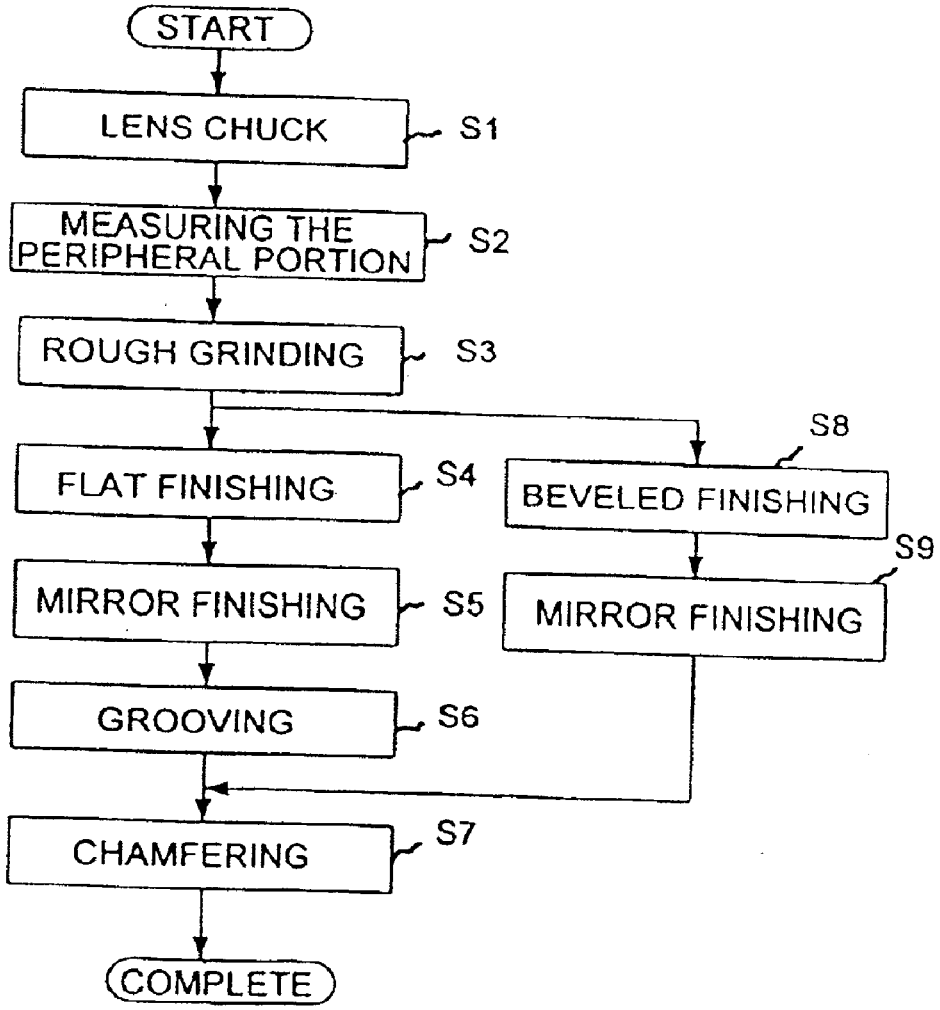
FIG. 14 shows a diagram exhibiting the steps of processing the lens.

In FIG. 14, the procedures conducted by the control portion 9 after the lens 1 is set into the lens-holding shaft 41 are shown. The data of the shape of the lens frame are read at the apparatus for measuring the shape of the frame 900 and the position for the grinding is calculated. After the conditions of the processing set at the operation portion 13 is read, in step S1, the shaft 41R of the lens-holding shaft 41 is displaced to the position for holding the lens 1 by driving the motor for the lens chuck 46 and the lens 1 is held under a pressure in accordance with the material of the lens 1. The lens unit 4 is elevated or lowered in accordance with the data of the shape of the lens frame and is positioned at the prescribed position for the measurement.

In step S2, the styluses 60 and 61 are brought into contact with the convex face 1*a* and the concave face 1*b*, respectively, of the lens 1 by driving the motor 62 for driving the styluses. The lens 1 is rotated by driving the motor for driving the lens 45. The lens unit 4 is elevated or lowered to the position in accordance with the rotation angle of the lens 1 (the position of the complete processing on the peripheral portion of the lens) based on the data of the shape of the lens frame (the data of the peripheral portion of the lens 1) and the position of the complete processing on the lens 1 is measured and stored into the means of memory 91.

When the measurement is completed, rough grinding is conducted in step S3. The lens unit 1 is moved to the prescribed position relative to the main rotating tool 50 (for example, the position directly above the rough grinder 50*a* in FIG. 2) by driving the base unit 2 and the elevating and lowering unit 3. Rough grinding is conducted by driving the motor 55 at the prescribed rotation speed and the lens 1 is formed into an approximately the same shape as that of the lens frame. During the processing, the load, the rotation speed of the lens shaft and the pattern of water supply are controlled based on the set values.

When the rough grinding is completed, flat finishing or beveled finishing is conducted in accordance with the presence or the absence of a bevel using the main rotating tool 50 based on the set values (steps S4 and S8).

When finishing is completed, mirror finishing is conducted, if desired, using the main rotating tool 50 based on the set values (steps S5 and S9).

When the above grinding is the flat grinding, the grooving of the peripheral face of the lens is conducted using the rotating tool 71 (step S6). In the final step, the chamfering of the peripheral portion of the lens is conducted using the rotating tool 70 (step S7). A series of processing steps are completed as described above.

J. Setting of the Conditions of the Processing

The setting of the conditions of processing by the operation portion 13 and the control portion 9 described above will be described as follows.

FIG. 15 shows an example of the setting of the table 945 shown in FIG. 12. FIG. 15(A) shows a table for rough grinding and FIG. 15(B) shows a table for finishing.

For glass, CR-39 (Plastic 1) and polycarbonates (Plastic 2) which are known materials, the conditions of the processing are set in advance, for example, as follows: the grinding speed: 1,000 m/min; the rotation speed of the lens shaft: 5 to 6 rpm; the direction of the grinding: down cut; the load: 3.5 to 4 kgf; dry processing without water supply in the rough grinding; and wet processing with continuous water supply in the finishing. (When the value is shown by a range, the central value is used for the setting.)

As described above, in the case of a new material for a lens such as a material for a lens made of a thermosetting resin and exhibiting a great resistance to grinding, heretofore, a satisfactory processing could not be achieved due to occasional attachment of dust and debris of grinding having the shape of ribbons and strings to the peripheral portion of the lens after the rough grinding in any of dry processing and wet processing when values for conventional materials such as the values for glass or Plastic 2 shown in Table 15(A) are used.

In the case of a lens exhibiting excellent impact strength which is formed with a polyurethane material prepared from an aliphatic diisocyanate compound, an intermediate having hydroxyl group selected from polyester glycols, polyether glycols and mixtures of these glycols and a primary aromatic diamine curing agent as disclosed by Japanese Patent Application (as a national phase under PCT) Laid-Open Nos. 2000-511231 and 2002-504935, as described above, the lens has the problem that melted dust and debris of grinding having the shape of ribbons and strings is occasionally attached to the peripheral portion of the processed lens when processing is conducted using a conventional apparatus. Furthermore, processing conducted after the above step such as finishing, chamfering and grooving is occasionally adversely affected.

The dust and debris of grinding removed from the peripheral portion of the lens is occasionally attached to and accumulated at the inner periphery of the apparatus and adversely affect the movement of the tools and the lens.

An example of the lens described above is formed with a polyurethane which is obtained by reacting a polyester glycol or a polyether glycol having a weight-average molecular weight of about 600 to about 1,200 with 4,4'-methylenebis(cyclohexyl isocyanate) in relative amounts by equivalent of 2.5 to 4.5 NCO per OH and preferably 3 to 3.5 NCO per OH to form a prepolymer, followed by reacting the formed prepolymer with a curing agent of an aromatic diamine in relative amounts by equivalent of 0.95 to 1.02 $NH_2$/1.0 NCO and preferably 0.96 to 1.0 $NH_2$/1.0 NCO. The lens made of the resin having the above composition will be referred to as the polyurethane lens having difficulty in grinding.

In the conventional apparatus described above, the load cannot be set as desired. Even when the load can be changed, the load can be changed in the direction of increasing the load from the ordinary value (about 3.5 to 4.0 kgf), i.e., in the direction of decreasing the time of processing, such as a load of 4.0 kgf or greater, but cannot be changed to a value smaller than the ordinary value (3.5 kgf). Therefore, conditions for preventing the formation of the dust and debris of grinding having shapes of ribbons and strings are hard to find in the processing of a difficult to-grind polyurethane lens.

As the result of the experiment of grinding using the apparatus for processing a lens of the present invention, it was found that, when the difficult-to-grind polyurethane lens having difficulty in grinding was processed under loads of grinding decreased from the ordinary value (about 3.5 to 4.0 kgf) as shown in the following Table, the attachment of melted dust and debris of grinding did not take place and the dust and debris became powder under loads smaller than 3 kgf. An excellent finished face could be obtained in the above conditions. The melting of the dust and debris could be prevented and the size of the dust and debris decreased when the load was further decreased. However, the time of the processing increased due to the decrease in the load. It was found by the experiment that both of the processability and the time of processing could be satisfactory when the load was 2 kgf, which is smaller than the ordinary value.

TABLE 1

| | Load (kgf) | | | | |
|---|---|---|---|---|---|
| | 2 | 2.5 | 2.75 | 3 | 3.5 |
| Melting of dusts of grinding | none | none | none | slight | marked |

(The rough grinding, the dry processing and the up cut)

It was also found that up cut and dry processing were necessary as the conditions in Table 1. In either down cut or wet processing, the melting of the dust and debris of grinding took place. As the rotating tool 50 used above, an electrodeposited diamond wheel was preferable to a sintered diamond wheel due to the more excellent grinding properties.

Since the load of the apparatus for processing a lens can be changed as desired by the unit for adjusting the load 8 and materials in a wide range can be treated by the operation portion 13, the polyurethane lens having difficulty in grinding can be surely processed by setting the rotation speed of the main shaft, the rotation speed of the lens shaft, the direction of grinding (the direction of rotation of the lens shaft), the load and the pattern of water supply as desired.

In the control table of the unit for controlling the load 8 shown in FIG. 9, the characteristic line L1 corresponds to a load of 4 kgf, the characteristic line L2 corresponds to a load of 3.5 kgf and the characteristic line L3 corresponds to a load of 2 kgf.

When the values shown in FIGS. 15(A) and 15(B) are set as Plastic 3 in the switch 138 of the means for presetting, the difficult-to-grind lens can be processed more easily.

In rough grinding of the difficult-to-grind lens, melting of the dust and debris of grinding can be surely prevented when the load is set at a value smaller than 3 kgf, dry processing is conducted in the up cut condition, the speed of grinding is increased to a value greater than the ordinary value of 1,000 m/min by 10% or greater, and the rotation speed of the lens shaft is increased to a value about twice as fast as the ordinary value. The speed of grinding changes depending on the relative rotating speeds of the main shaft and the lens shaft. In the above, the rotation speed of the lens shaft is neglected since the rotation speed of the lens shaft is much smaller than the rotation speed of the main shaft. For setting an accurate speed of grinding, the rotation speed of the lens shaft and the direction of the rotation (the direction of the grinding) are taken into consideration. When the outer diameter ϕ of the main rotating tool is constant, the rotating speed of the main shaft may be listed in the table in place of the speed of grinding.

In finishing the difficult-to-grind lens, as shown by Plastic 3 in FIG. 15(B), the speed of grinding and the rotation speed of the lens shaft are changed to ordinary values (glass~Plastic 2) and the condition of water supply is changed from dry processing to wet processing started during the processing while the load and the direction of grinding are kept the same as those in the rough grinding. Excellent finishing can be achieved in a decreased time under these conditions.

It is preferable that the time when dry processing is changed to wet processing during processing is in the final step or in the later steps of processing. For example, dry processing can be changed to wet processing when the margin for grinding reaches 0.1 to 0.2 mm in the radial direction. For the finishing of the difficult-to-grind lens, a conventionally used sintered diamond grinder for finishing can be used as the rotating tool 50. It is preferable that the speed of grinding and the rotation speed of the lens shaft are changed when the rotating tool 50 is changed.

Figure 16:
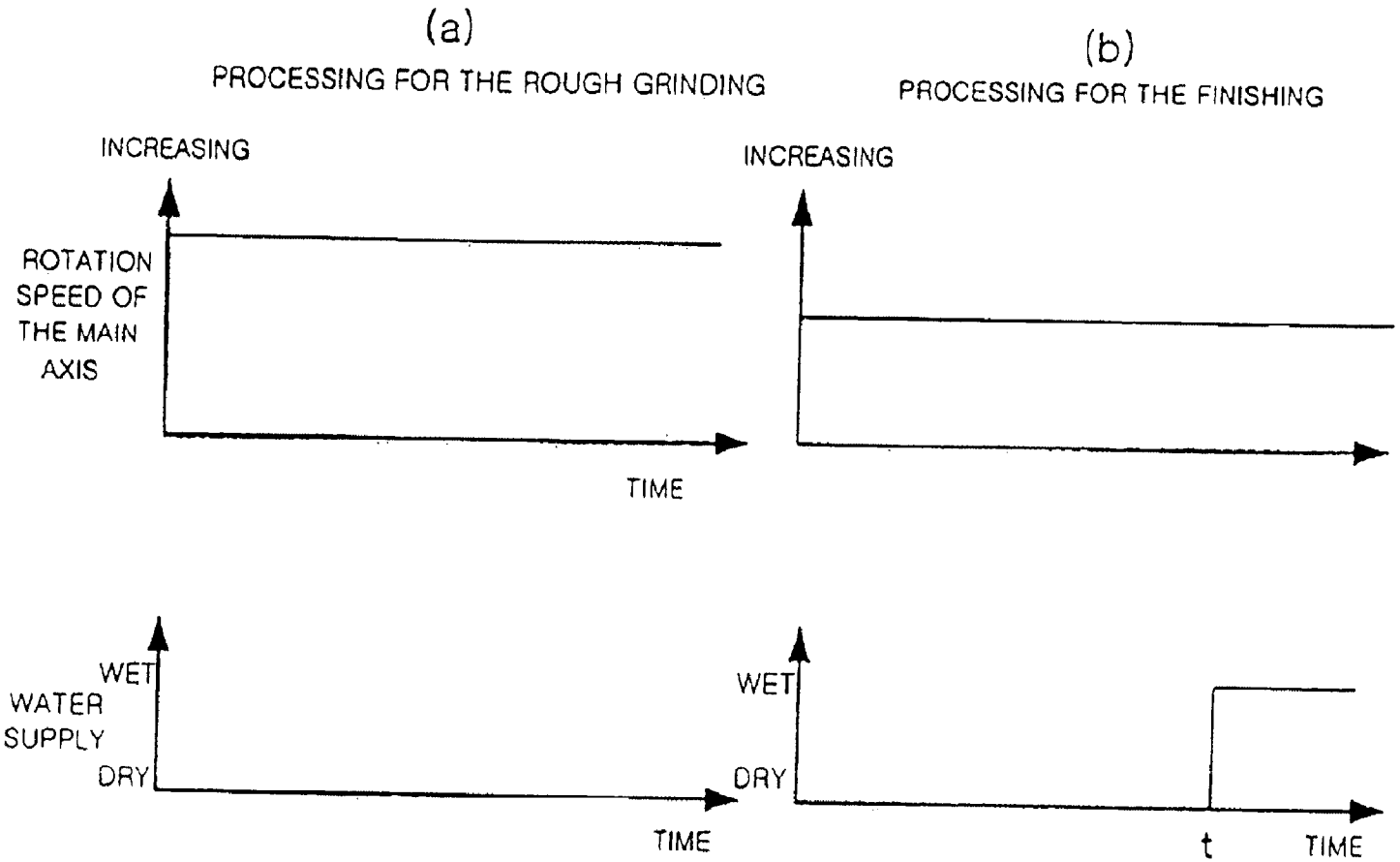
FIG. 16 shows a diagram exhibiting the difference in the conditions of the processing in accordance with the material of the lens using the relations between the rotation speed of the main shaft or the condition of water supply and the time, wherein (A) shows the diagram for the rough grinding and (B) shows the diagram for finishing.

When the above conditions of the processing are set at the selection switch 138 of the means for presetting and the rough grinding and the finishing of the lens 1 are conducted, the relations between the speed of grinding (the rotation speed of the mains shaft) or the condition of water supply and the time are as shown in FIG. 16.

For rough grinding, dry processing is conducted at a great speed of grinding (for example, 1,256 m/min) as shown in FIG. 16(A). When rough grinding is completed, as shown in FIG. 16(B), the speed of grinding is decreased and the finishing is started in accordance with the dry processing. At the time t in the final step of finishing, the supply of water is started and the cooling liquid is injected toward the lens 1. Thus, the processing is converted into wet processing in the later stage of finishing.

Since the desired load can be set by the unit for controlling the load 8, the processing can be conducted not only for conventional materials such as glasses, CR-39 and polycarbonates but also for new materials. Since the direction of processing (up cut or down cut), the speed of grinding and the condition of water supply can be changed at every step such as the rough grinding and the finishing, the processing can be conducted surely even when the conditions of the processing are different among the steps as shown for the difficult-to-grind lens.

In the above embodiment, the weight of the lens unit 4 is adjusted in accordance with the tension of the spring 84 in the unit for controlling the load 8. Alternately, an elastic material may be used as the wire 83 in place of the spring 84.

In the above embodiment, the unit for controlling the processing pressure 8 has the construction such that the lens unit 4 is suspended from an upper position. Alternatively, the lens unit 4 may be pushed from a lower position to the upward direction.

In the above embodiment, the unit for controlling the load 8 Alternatively, the lens unit 4 may be directly suspended by the wire 83 and the load applied to the lens 1 may be adjusted in accordance with the force of driving or the amount of driving of the motor 81.

In the above embodiment, the apparatus for processing a lens is the so-called apparatus of the vertical movement which conducts the processing with the displacement of the lens 1 in the vertical direction. The present invention can also be applied to an apparatus which conducts the processing by supporting the lens by an arm swinging relative to the main shaft in the conventional manner.

While the present invention has been described in terms of illustrative embodiments, one of ordinary skill in the art will recognize that additions, deletions, substitutions and improvements can be made while remaining within the scope and spirit of the present invention, as defined by the appended claims.

What is claimed is:

1. An apparatus for processing a lens, comprising:

a lens holding unit displaceable in a vertical direction and having a lens shaft arranged to hold a lens to be processed;

a main shaft unit equipped with a rotating tool and disposed to processes a peripheral portion of a spectacle lens held in the lens holding unit, in accordance with shape data of a lens portion of a spectacle frame, when the lens holding unit is displaced to contact a lens held in the lens holding unit with the rotating tool;

a load adjusting device equipped to adjust a load pressing the lens to the rotating tool;

a lens shaft drive connected to drive the lens shaft with a changeable rotational speed and direction of rotation;

a cooling device arranged to inject a cooling liquid toward the lens held in the lens shaft;

a means for setting processing conditions for the load adjusting device, the drive and the cooling device; and a control means for controlling the load adjusting device, the drive and the cooling device based on output from the means for setting processing conditions, wherein the control means for controlling is connected to receive output from the means for setting processing conditions.

2. An apparatus according to claim 1, wherein the means for setting processing conditions sets in advance controlling conditions in a plurality of processing steps for a plurality of lens materials.

3. An apparatus according to claim 2, wherein the control means comprises a means for switching a cooling condition which switches between running and stopping of injection of the cooling liquid by the cooling device during the processing and the means for setting processing conditions sets running or stopping of injection in a plurality of processing steps.

4. An apparatus according to claim 1, wherein the apparatus further comprises a main shaft drive connected to drive the main shaft unit with a changeable rotational speed; and the means for setting processing conditions sets a rotation speed of the main shaft in a plurality of processing steps and the control means controls the main shaft drive based on the output of the means for setting processing conditions.

5. An apparatus according to claim 2, wherein the apparatus further comprises a main shaft drive connected to drive the main shaft unit with a changeable rotational speed; and the means for setting processing conditions sets a rotation speed of the main shaft in a plurality of processing steps and the control means controls the main shaft drive based on the output of the means for setting processing conditions.

6. A process for processing a lens, comprising the steps of:

(a) supporting a lens on a shaft of a lens support unit;

(b) displacing the lens relatively to a main shaft having a rotating tool and processing a peripheral portion of the lens in accordance with shape data a lens portion of a spectacle frame;

wherein the processing further comprises the steps of (c) rough grinding by pressing the lens to the rotating tool under a load set in advance and grinding the lens roughly; and (d) finishing by pressing the lens to the rotating tool under a load set in advance, wherein the finishing is started without injection of a cooling liquid, and completed with injection of the cooling liquid.

7. A process according to claim 6, further comprising changing the load in accordance with a material of the lens.

8. A process according to claim 6, wherein the lens is formed with a polyurethane-based resin, the loads are set at a value of 2 kgf or greater and smaller than 3 kgf, and rotation of the holding shaft and rotation of the main shaft are set in same direction.

9. A process for processing a lens comprising the steps of:

(a) supporting a resin lens with the lens holding shaft of a lens holding unit;

(b) displacing the lens relatively to a main shaft having a rotating tool; and (c) processing a peripheral portion of the lens in accordance with shape data of lens portion of a spectacle frame;

wherein the processing further comprises the steps of:

i. pressing the lens to the rotating tool under a load set in advance;

ii. starting injection of a cooling liquid in accordance with wet processing;

iii. stopping injection of the cooling liquid in accordance with dry processing; and iv. setting rotation of the lens holding shaft and rotation of the main shaft in the same direction; and wherein the lens comprises a polyurethane material prepared from an aliphatic diisocyanate compound, an intermediate compound having hydroxyl group which is selected from polyester glycols, polyether glycols and mixtures of the glycols and a curing agent of an aromatic primary diamine.

10. A process according to claim 9, wherein the load is set at a value of 2 kgf or greater and smaller than 3 kgf.

11. An apparatus for processing a lens, comprising:

a lens holding unit displaceable in a vertical direction and having a lens shaft arranged to hold a lens to be processed;

a main shaft unit equipped with a rotating tool and disposed to process a peripheral portion of a spectacle lens held in the lens holding unit, in accordance with shape data of a lens portion of a spectacle frame, when the lens holding unit is displaced to contact a lens held in the lens holding unit with the rotating tool;

a load adjusting device equipped to adjust a load pressing the lens to the rotating tool;

a lens shaft drive connected to drive the lens shaft with a changeable rotational speed and direction of rotation;

a cooling device arranged to inject a cooling liquid toward the lens held in the lens shaft;

a means for setting processing conditions for the load adjusting device, the drive and the cooling device; and a control means for controlling the load adjusting device, the drive and the cooling device based on output from the means for setting processing conditions, wherein the control means for controlling is connected to receive output from the means for setting processing conditions, and wherein the control means for controlling comprises a means for switching a cooling condition which switches between running and stopping of injection of the cooling liquid by the cooling device during the processing and the means for setting processing conditions sets running or stopping of injection in a plurality of processing steps.

* * * * *